US005647135A

United States Patent [19]

Fuentes et al.

[11] Patent Number: 5,647,135

[45] Date of Patent: Jul. 15, 1997

[54] DRAFTING INSTRUMENT WITH ELECTRONICALLY CONTROLLABLE SCALE

[76] Inventors: Alejandro Fuentes, 610 Valencia, Apt. 303, Coral Gables, Fla. 33134; Arturo Gomez, 11360 SW. 47 Ter., Miami, Fla. 33165

[21] Appl. No.: 510,966

[22] Filed: Aug. 3, 1995

[51] Int. Cl.[6] ..... B43L 7/04

[52] U.S. Cl. ..... 33/494; 33/1 M; 33/1 PT; 33/449; 33/483

[58] Field of Search ..... 33/1 PT, 418, 33/421, 429, 448, 449, 483, 494, 124, 534, 772, 773, 1 M, 679.1

[56] References Cited

U.S. PATENT DOCUMENTS

| | | | |
|---|---|---|---|
| 4,184,261 | 1/1980 | Buerner | 33/18 |
| 4,237,617 | 12/1980 | Goussios | 33/427 |
| 4,244,105 | 1/1981 | Goussios | 33/1 |
| 4,246,703 | 1/1981 | Robinet | 33/430 |
| 4,270,277 | 6/1981 | Koenuma | 33/439 |
| 4,282,571 | 8/1981 | Giovannoli | 364/562 |
| 4,370,811 | 2/1983 | Triggs | 33/32 |
| 4,386,470 | 6/1983 | Perry | 33/438 |
| 4,419,823 | 12/1983 | Thorban | 33/1 |
| 4,430,797 | 2/1984 | Eder | 33/1 |
| 4,468,860 | 9/1984 | Rodengen | 33/1 PT |
| 4,492,031 | 1/1985 | Koenmua | 33/1 |
| 4,738,029 | 4/1988 | Held | 33/18.1 |
| 5,040,298 | 8/1991 | Weber | 33/1 |
| 5,050,312 | 9/1991 | McCannon | 33/494 |
| 5,115,569 | 5/1992 | Kubo | 33/1 |
| 5,404,648 | 4/1995 | Taylor, Jr. | 33/431 |

FOREIGN PATENT DOCUMENTS

| | | | |
|---|---|---|---|
| 1-92601 | 4/1989 | Japan | 33/494 |

*Primary Examiner*—G. Bradley Bennett

*Attorney, Agent, or Firm*—Morgan, Lewis and Brockius LLP

[57] ABSTRACT

A self-contained drafting instrument adapted for rapid measurement of diagrams or drawings on a surface. The instrument utilizes an internal movement detection mechanism, an electronics processing system, and a display screen capable of graphical representation. The movement detection mechanism measures both orthogonal components of movement and the display screen provides a scale that electronically scrolls as the instrument moves or by manually pressing a key on a keyboard. The drafting instrument can be constructed in a number of orientations including a ruler, drafting triangle, protractor, or T-square.

40 Claims, 28 Drawing Sheets

SCALE CONVERTED FROM SEXAGECIMAL TO CENTECIMAL ANGLE SYSTEM

TRANSPOSE ANGLE READING AND GRAPHIC SCALE

ORIGINAL SCALE LAYOUT

• NOTICE THAT SCALE READS FROM LEFT TO RIGHT

ROTATION AND RELOCATION OF TRIANGLE

• NOTICE THAT SCALE READS FROM RIGHT TO LEFT

TRANSPOSE THE SCALE

- NOTICE THAT SCALE READS FROM LEFT TO RIGHT

DRAFTING INSTRUMENT WITH ELECTRONICALLY CONTROLLABLE SCALE

BACKGROUND OF THE INVENTION

1. Field of the Invention

This invention relates to a drafting instrument particularly suited for the rapid measurement of engineering and architectural drawings by employing a highly versatile display device.

2. Description of the Related Art

A technological gap exists between computers and traditional drafting tools. This gap has been created by the fast pace in which the computer industry has developed and the degree of stagnation that has characterized the drafting tools industry. As a result of this gap, the conceptual designer continues to use the same drafting tools used centuries ago.

A general misconception exists among those skilled in the drafting arts that computers are the solution for most time-consuming, routine work. However, in the drafting art there is much human involvement that can never be replaced by the computer. The final product of the drafting process results from many discussions, proposals, counter-proposals, quality control reviews, revisions, and other tasks. In many of these tasks, human involvement and the actual use of drafting tools are indispensable.

More particularly, every design begins with the conceptual stage. Usually, one or more engineers work at a large table, brainstorm, perform calculations, and create a draft that eventually matures into a finished product. The engineers use Metric and English scales, protractors, transporters, compasses, triangles, rulers and other drafting tools. As can be seen, the typical computer drafting systems are ineffective or awkward in the conceptual stage.

Furthermore, conventional computer drafting systems do not provide a satisfactory solution to engineers working in the field or on a construction site. In these circumstances, the drawings are typically memorialized on paper, and the engineer must rely on more traditional drafting instruments. For example, an engineer working in the field may be required to draw in the field book an unexpected, but common, change in the initial alignment design. Clearly, such a situation does not lend itself to computer drafting systems.

For an engineer in the field, large numbers of drafting tools are cumbersome and undesirable. For example, an engineer in the field could use a straight edge, a scale, a protractor, and a compass to perform the task discussed above which, as can be seen, is cumbersome and difficult. A highly versatile, user-friendly instrument would assist the professional tremendously.

In addition, the United States is presently transitioning from the English Unit System to the Metric Unit System. Accordingly, an engineer often converts from one system to the other in his work. Even when the transition is complete, our roads and buildings—most of which designed in the English Unit System—will eventually need repairs, remodeling, and reconstruction. Therefore, conversion will still be required. A drafting instrument that conveniently allows for rapid conversion between scales is desirable.

Conventional drafting tools have several limitations. First, conventional electronic measuring instruments usually require a guiding mechanism for use, such as a frame or a drafting table edge. The instruments of this type cannot easily be moved over the entire surface of a drafting table because of the space required for the guiding mechanisms. Furthermore, the guiding mechanisms may be cumbersome or non-portable, and not appropriate for use in the field.

An attempt to solve some of these problems is found in U.S. Pat. No. 4,237,617 to Goussios which shows a drafting machine in FIG. 1*a* which measures horizontal displacement using a photosensor 30 which reads a ruled tape 33 located along a horizontal edge 35. An alternate embodiment of this drafting machine is shown in FIG. 4 and uses a roller 48 with a shaft encoder 40 to measure the horizontal displacement of the first triangle 10. This device, however, still suffers from the drawbacks of using a guiding mechanism and measuring movement in only one direction.

Also, U.S. Pat. No. 4,246,703 to Robinet shows an electronic drafting instrument with a drive wheel 12 and a rotary incremental encoder 13 to measure the component of displacement perpendicular to the shaft 35. Similarly, this device suffers from the drawback of only allowing measurement of movement in one direction.

As can be seen, the measurements performed by these conventional instruments are limited to one direction and do not provide any flexibility. Accordingly, an engineer would be greatly assisted by a tool that could automatically record both horizontal and vertical distances in an extremely flexible fashion and without the restrictions of guiding mechanisms.

The displays used in the conventional devices further limit their usefulness. Conventional drafting instruments typically have a fixed scale along an edge. Conventional drafting instruments may include a digital display. For example, U.S. Pat. Nos. 4,184,261 to Buerner, 4,244,105 to Goussios, 4,386,470 to Perry, 4,738,029 to Held, and 5,040,298 to Weber all show devices with a display.

Devices such as shown in U.S. Pat. No. 4,246,703 to Robinet show a numerical display with a fixed scale at the edge. U.S. Pat. No. 4,282,571 to Giovannoli integrates a numerical display 18 and a series of LEDs 46 along edge 11. The LEDs serve as a moveable cursor 24 to mark the distance to be measured and displayed. These devices do not provide the needed advantages.

By removing the user's visual collaboration of the measurement, the mechanistic output of digital displays tends to cloud the user's usual distance perception during the measuring process. In other words, digital displays also suffer from the drawback of preventing the user from using visual perception of distance to confirm the measurements being taken. Errors can result from improper setting of the instrument because of this drawback. For example, if a conventional digital display instrument was inadvertently set in centimeters rather than inches, measurements could be taken erroneously, whereas if a centimeter scale were visually presented to the user, the user may visually perceive the error and correct it. Clearly, an instrument that provides not only the digital alpha-numeric display but also a traditional visual scale is desirable.

While the fixed scales along the edge of a conventional instrument do not present this problem, such conventional scales are undesirably limited to specific unit systems and scaling factors, and are intrinsically limited in the number of unit systems and scaling factors that may be shown. Moreover, fixed scales, which are limited in length, make the measurement of long distances difficult and cumbersome, and also may introduce measurement error. A highly versatile display system would significantly aid the engineer in efficiently interpreting and preparing drawing sheets.

SUMMARY OF THE INVENTION

The present invention has been made in view of the above circumstances and has an object to provide multipurpose drafting instruments capable of automatically measuring two dimensional displacement components. A further object of the present invention is to provide drafting instruments with a versatile display screen which provides a controllable scale.

The invention has as additional objects to perform tasks that conventional scales cannot, such as find an unknown scale on a plan, determine the appropriate scaling factors to fit a drawing in a sheet of given dimensions, store scale files for later use, and convert scales from one unit system to the other.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a drafting instrument adapted for rapid measurement by a user of diagrams or drawings on a surface comprising a body having an edge and a cavity, means for detecting movement of the body on the surface and for generating a signal representing detected movement, the detection means located adjacent to the body, electronics processing means operatively connected to the detection means and located in the cavity for receiving and processing the signal from the detecting means to generate a display output signal, display means operatively connected to the electronics processing means and located adjacent to the edge for displaying an image including a scale, the display means receiving the output signal from the processing means so that the scale electronically scrolls.

To achieve the objects and in accordance with the purpose of the invention, as embodied and broadly described herein, in another aspect the invention comprises a self-contained drafting instrument adapted for rapid measurement by a user of diagrams or drawings on a surface comprising a body having an edge and a cavity, means for detecting two dimensional movement of the body on the surface and for generating a signal representing the horizontal and vertical displacement components of the two dimensional movement of the body on the surface, the detection means located adjacent to the body, electronics processing means operatively connected to the detection means and located in the cavity for receiving and processing the signal from the detecting means to generate a display output signal, display means operatively connected to the electronics processing means for displaying information corresponding to the displacement components, the display means receiving the output signal from the processing means to change the information as the body moves.

To achieve the objects and in accordance with the purpose of the invention, as embodied and broadly described herein, in yet another aspect the invention comprises a drafting instrument adapted for rapid measurement of angles or slopes on diagrams on a surface comprising a body having an edge and a cavity, fixing means adapted to allow the body to be rotated through an angular displacement on the surface about an axis passing through the fixing means and orthogonal to the surface, the fixing means located proximate to the edge, means for detecting movement of the body on the surface and for generating a signal representing detected movement, the detecting means located adjacent to the body, electronics processing means operatively connected to the detection means and located in the cavity for receiving and processing the signal from the detecting means to generate a display output signal, display means operatively connected to the electronics processing means and located adjacent to the edge for displaying information corresponding to the angular displacement of the body, the display means receiving output signal from the processing means to change the information as the body is rotated.

BRIEF DESCRIPTION OF THE DRAWINGS

The accompanying drawings, which are incorporated in and constitute a part of this specification illustrate embodiments of the invention and, together with the description, serve to explain the objects, advantages, and principles of the invention. In the drawings.

DETAILED DESCRIPTION OF THE PREFERRED EMBODIMENTS

The present invention generally is directed to a range of embodiments for self-contained electronically operated drafting instruments adapted for rapid measurement of diagrams or drawings on a surface. The drafting instruments can be constructed in a number of configurations including a simple ruler, a ruler with sliding vertical rule, a drafting triangle, a protractor, or an inclination gauge. Some of these configurations may additionally be used in conjunction with any guiding and pivoting mechanisms and may be used with most of the well known drafting tools when desired. The following detailed description of these embodiments will be divided into convenient sections for purposes of explanation.

RULER

Figure 1A:
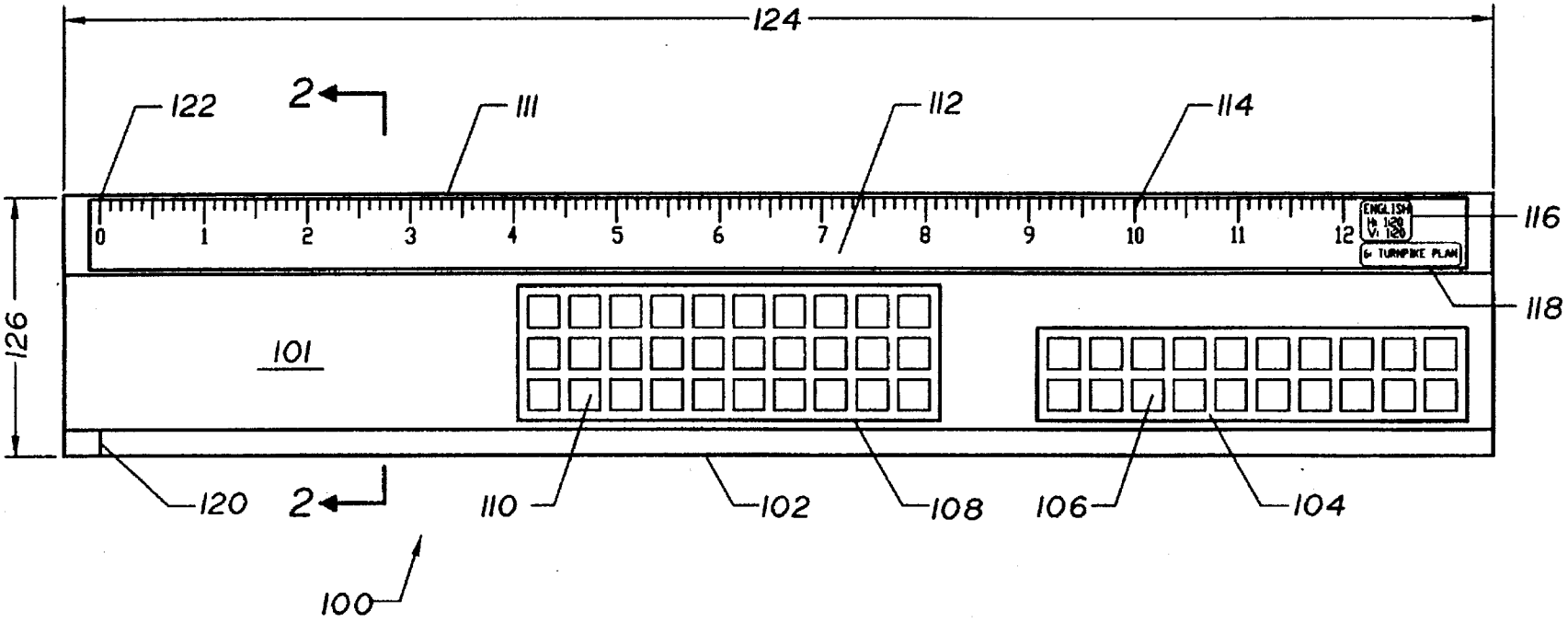
FIG. 1*a* is a top view of an embodiment of the present invention.

FIG. 1*a* shows an embodiment of the present invention as a ruler 100. The body 102 is hollow and resembles a common flat scale to facilitate handling by the user. In particular, FIG. 1*a* shows a top surface 101 of a ruler 100 containing a body 102, and a user input mechanism on the top surface 101, such as a keyboard 104 containing keys 106. In addition, the top surface 101 contains an optional calculator keyboard 108 containing calculator keys 110. Of course, other appropriate user input devices could be considered such as will be apparent.

Through the calculator keyboard 108, the user may operate additional capabilities of the processing electronics such as a simple scientific calculator, a handheld calculator that provides numeric and mathematical functions, an alternate keyboard to choose from the different functions assigned to the keys, and a continuous memory.

Proximate to and along the length of a top edge 111 of the body 102 is a display screen 112. In the preferred embodiment, the screen is as close to the top edge 111 as possible, typically ⅛ inch from the top edge or less, and preferably at the top edge. The cross-section of the display screen 112 can be straight or slightly curved. The display screen 112 is an electronically controllable screen capable of displaying in graphical representation any of a variety of images or scales, and can be built using a variety of technologies, such as a liquid crystal display (LCD). Such screens are conventionally known and available.

Figure 17:
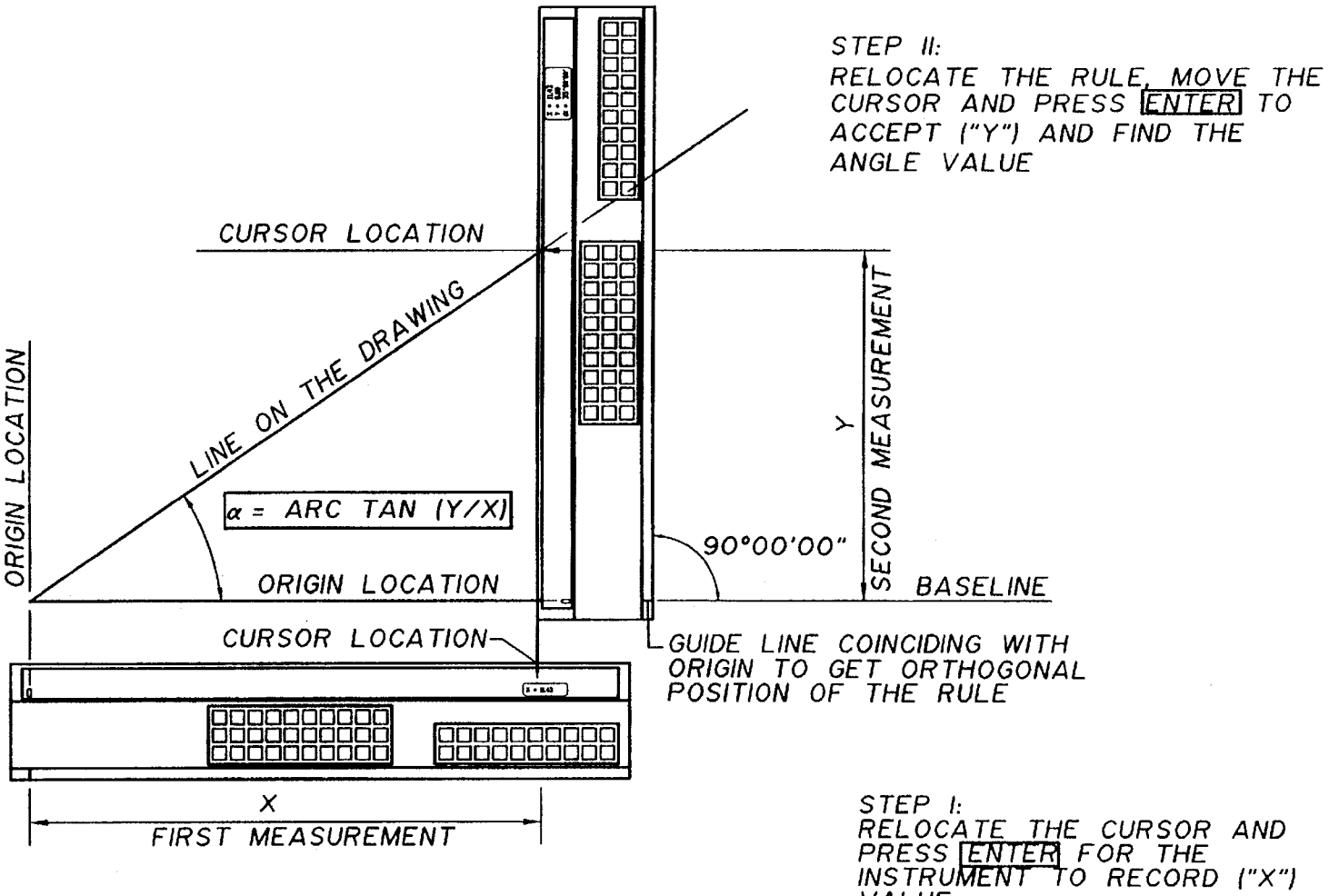
FIG. 17 is a top view of a ruler used to measure an angle.

In FIG. 1*a*, the display screen 112 is shown with a scale 114 and various information boxes, such as a scale information box 116 and a current scale file box 118. A guide line 120, proximate to the lower edge of the body 102, assists the user in accurately positioning the body 102 in an orthogonal position as shown in FIG. 17. When the scale 114 is reset, by pressing the appropriate key 106, the guide line 114 will be vertically aligned with an origin 122 of the scale 114. Consequently, when both the origin 122 and the guide line 120 are aligned with any line on a drawing sheet, the body 102 will be at a right angle to that line. The body 102 can be any dimension desired, but the length 124 is preferably greater than the width 126, and a preferred dimension is 13"×2½". Dimensions of the body 102 may vary as a result of the operations assigned. For example, the width 126 will vary with the total number of keys 106 required by the particular application intended. The body 102 may be constructed from any material desired, preferably plastic or metal.

Figure 2:
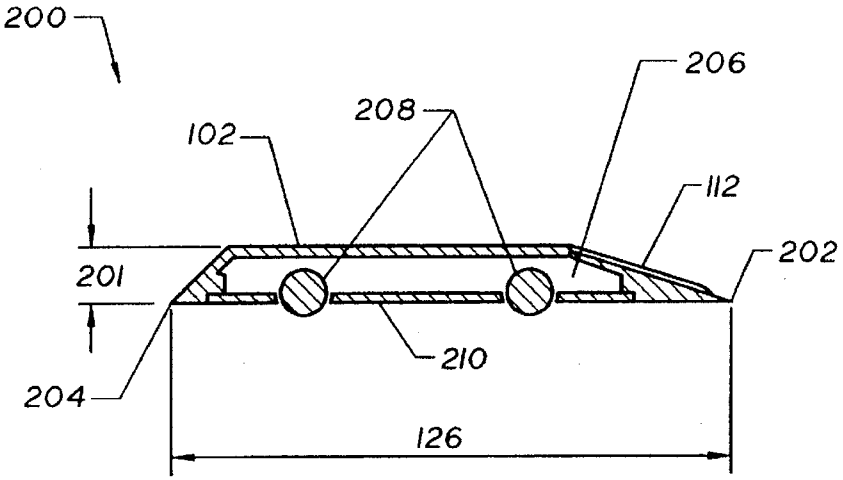
FIG. 2 is a cross-sectional view of a ruler body with two bearings at either end.

FIG. 2 shows a cross section of the body 102 of the ruler 100. The thickness 201 of the body 102 is preferably as small as necessary to accommodate the needed internal components of the invention, which are described in more detail below. Generally, the thickness 201 is the smallest dimension, preferably on the order of about ¼ of an inch. The body 102 contains a front edge 202 on which the display screen 112 lies. The body 102 also contains a rear edge 204 on which the guide line 120 lies. These edges are beveled as shown in FIG. 2 to assist the user in precisely referencing the location of lines or marks on an engineering drawing sheet. The beveled front edge 202 also serves to protect the display screen 112 from wear and tear. This bevel should be as narrow as possible to maximize the accuracy of the instrument. The top surface 101 of the body 102 is inclined toward the bevel edge where the scale is found.

Figure 1B:
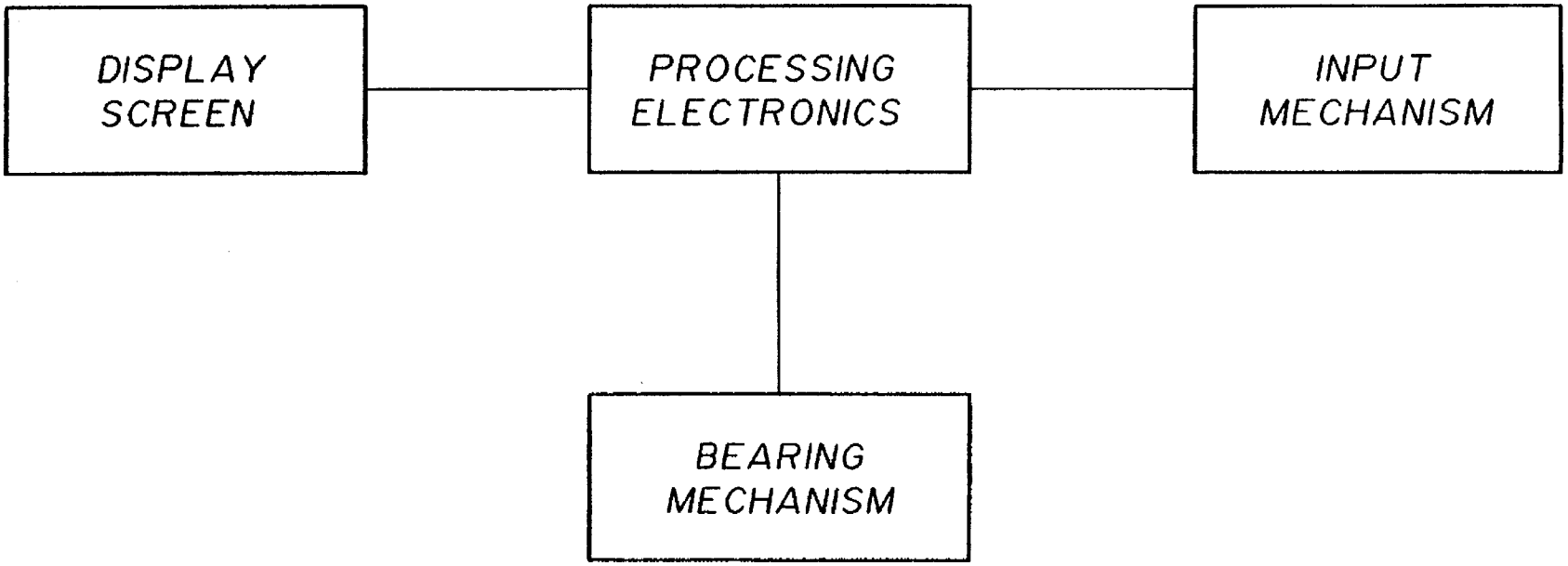
FIG. 1*b* is a block diagram representing the operative relationship of the bearing mechanisms, processing electronics, and input mechanism, and display screen.
Figure 3:
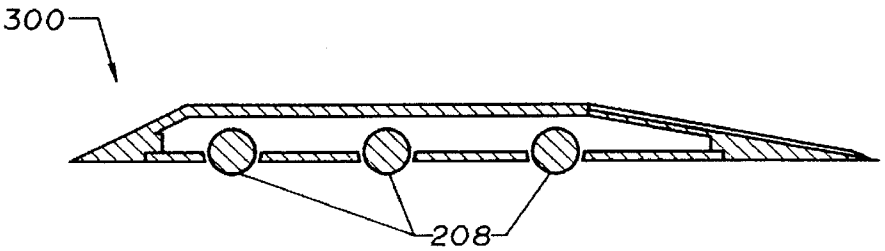
FIG. 3 is a cross-sectional view of a ruler body with three bearings at either end.

The body also defines a cavity 206 containing the processing electronics (not shown in FIG. 2) which provide an output signal to the display screen 112 as shown in FIG. 1*b*. Bearing mechanisms 208 assist the movement of the body 102 over the surface on which the body 102 rests, and some bearings 208 detect the amount and direction of the displacement of the body 102 over that surface. The bearing mechanisms 208 are preferred in applications when the instrument acts as a protractor, transporter, or slope gauge as will be described. The bearing mechanisms 208 are housed in the body 102 and protrude from the lower surface 210 as shown in FIG. 2. The bearing mechanisms 208 produce an electrical signal as the body 102 moves over the surface. This signal is transmitted to the processing electronics (not shown in FIG. 2) which interprets and processes the horizontal and vertical displacement components of the body 102. The processing electronics uses this information to update the output of the display screen 112. Preferably, the bearing mechanisms are positioned near both the right and left sides of the body 102 shown in FIG. 1*a*. The invention may encompass a two bearing configuration 200 as shown in FIG. 2, or a three bearing configuration 300 as shown in FIG. 3. A three bearing configuration could be desirable for embodiments with wider bodies.

Figure 4:
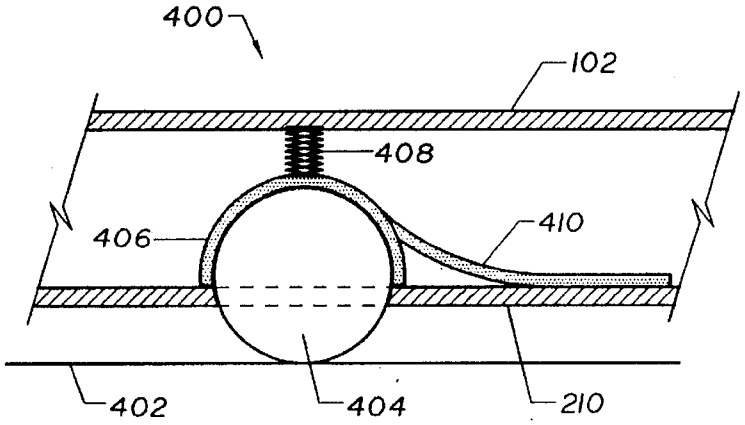
FIG. 4 is cut-away view of a displacing bearing mechanism in a locked position.

FIGS. 4 through 7 generally show several configurations of bearing mechanisms. FIG. 4 shows a displacing bearing mechanism 400 on a surface of a drawing board 402. The displacing bearing mechanism 400 includes a bearing 404 housed in a bell sleeve 406 which positions the bearing 404. The bell sleeve 406 is positioned by a resort 408 and a spring 410. The resort 408 and the spring 410 can lock the bearing 404 in place by pressing the bell sleeve 406 downward. In this position, the bearing 404 is pressed into contact with the lower surface 210 of the body 102, to prevent the bearing 404 from rotating, thereby locking the bearing 404 and the body 102 in place. The bearing 404 may have a tacky surface, such as a rubberized coating, to prevent sliding.

Figure 5:
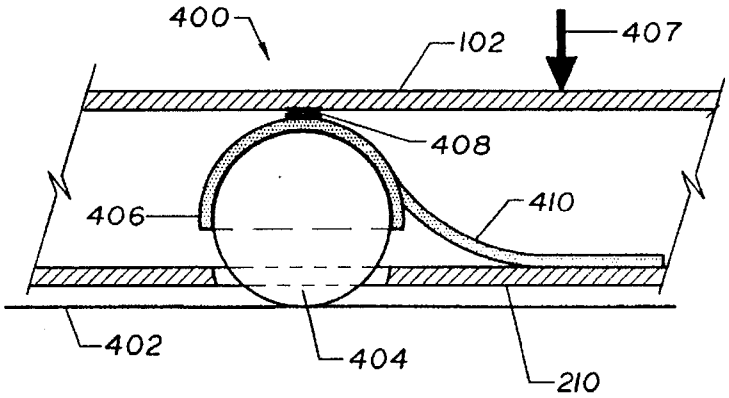
FIG. 5 is a cut-away view of a displacing bearing mechanism in an unlocked position.

As shown in FIG. 5, the bearing 404 may be unlocked by applying a downward force shown by arrow 407 to the body 102 to compress the resort 408 which releases the bearing 404 from the lower surface 210 of the body 102. In this position, the bearing 404 is free to rotate and the body 102 is easily moved. When the downward force shown by arrow 407 is terminated, the resort 408 and spring 410 force the bearing 404 into contact with the lower surface 210 to lock the displacing bearing mechanism 400, as previously described.

A measuring bearing mechanism 600 is preferably located at each end of the body 102. This measuring bearing mechanism is preferably designed similarly to a conventional mouse ball in a mouse which is well known in the computer arts.

Figure 7:
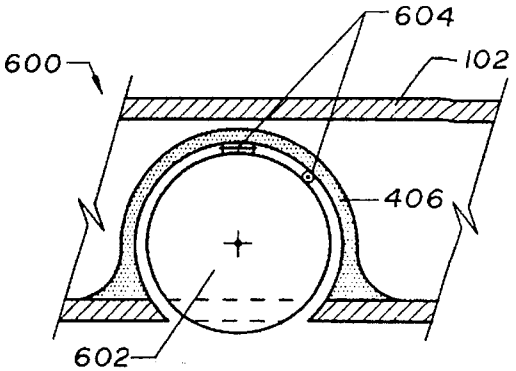
FIG. 7 is a side cut away view of a measuring bearing mechanism.
Figure 6A:
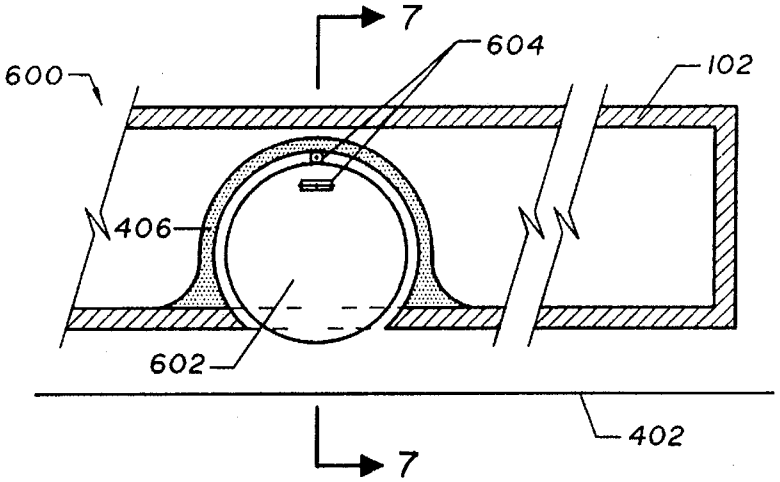
FIG. 6*a* is a front cut-away view of a measuring bearing mechanism in contact with the drawing board surface.

One possible configuration of a mouse-type measuring bearing mechanism 600 is shown in FIGS. 6*a* and 7. The measuring bearing mechanism 600 contains a bearing 602 within a bell sleeve 604. The bearing 602 is free to rotate along any axis. The rotation of the bearing 602, and the corresponding movement of the body 102, is measured by the displacement sensors 604. In a preferred arrangement, one displacement sensor 604 measures the horizontal movement while the other displacement sensor 604 measures the vertical movement of the body 102 on the surface of the drawing board. As a result, the two displacement sensors are oriented 90° with respect to each other as shown in FIGS. 6*a* and 7.

Figure 6B:
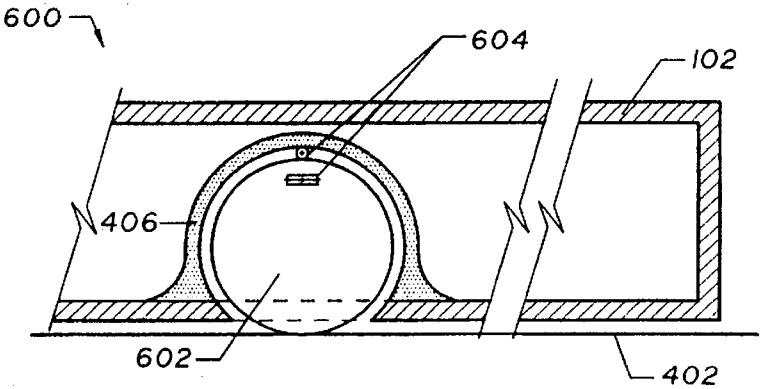
FIG. 6*b* is a front cut-away view of a measuring bearing mechanism in contact with the drawing board surface.

In the embodiment shown in FIGS. 6*a* and 7, the bearing 602 does not contact the surface 402 until the aforementioned displacing bearing mechanism 400 of FIG. 4 is compressed by the user. When a downward force shown by arrow 407 is applied, the bearing 602 makes contact with the surface 402 as shown in FIG. 6*b*. Movement of the body 102 causes the bearing 602 to turn the displacement sensors 604, thereby producing an electrical signal from an appropriate encoder (not shown). When the downward force 407 is terminated, the displacing bearing mechanism 400 expands and the measuring bearing mechanism 600 is lifted out of contact with the surface of the drawing board 402, thereby locking the body 102 in place. The body can be locked through a simple toggle key as well.

Figure 8:
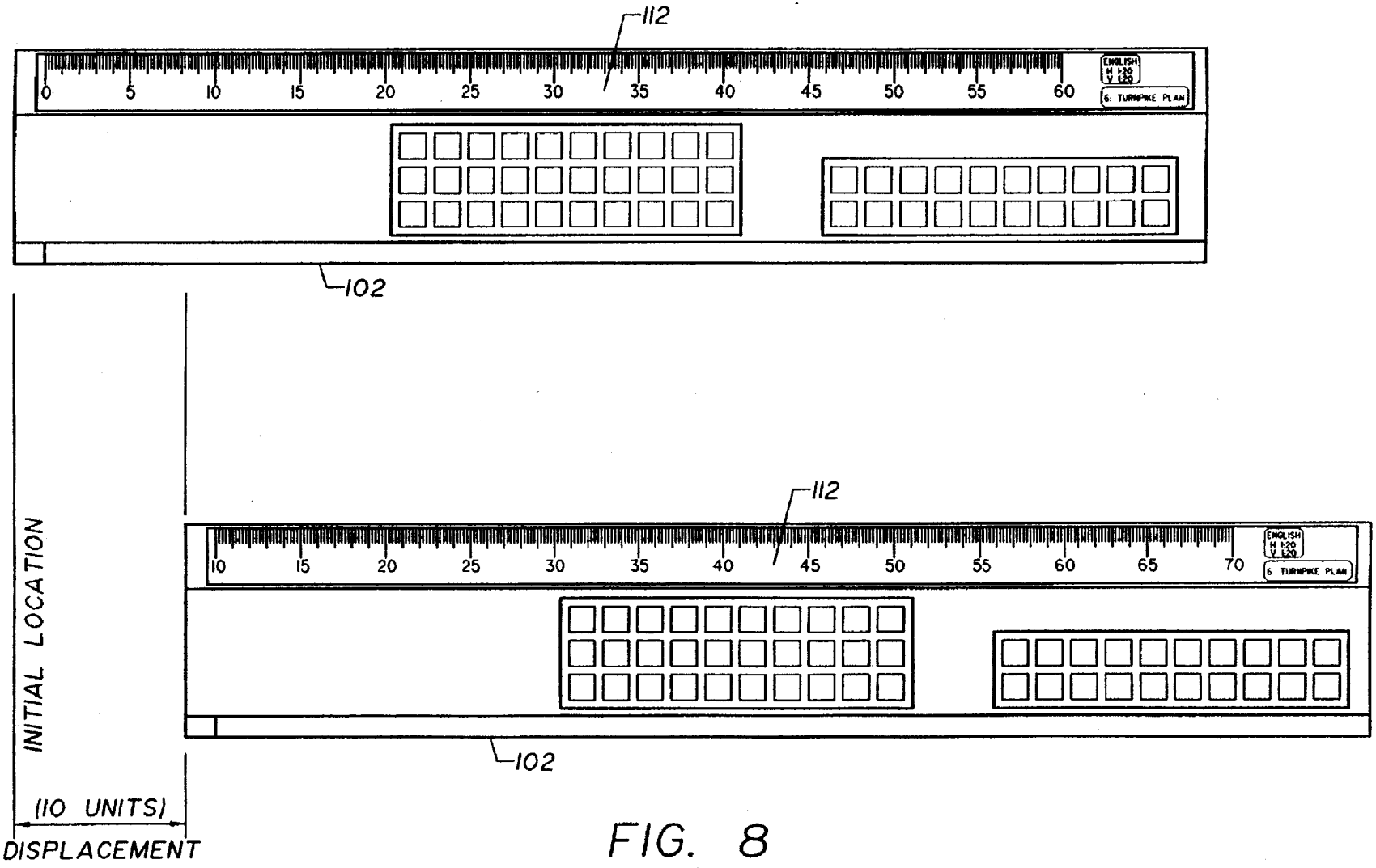
FIG. 8 is a top view of a ruler body showing a display screen electronically scroll.

The measuring bearing mechanism 600 produces an electrical signal received by the processing electronics which utilizes this information to determine the displacement of the body 102. The processing electronics outputs a signal to update the display screen in a variety of ways which may include updating a display of the coordinates of the body 102. Alternatively, the origin may be locked in space and the display screen 112 electronically scrolls as the body is moved as shown in FIG. 8, where the body 102 has been displaced to the right 10 units. In doing so, the display screen 112 has electronically scrolled 10 units and now reads 10 to 70 rather than 0 to 60.

The preferred embodiment is capable of performing a number of operations controlled using the keyboard 104 and a menu system. The keyboard 104 preferably includes keys 106 corresponding to on/off, menu, scan, convert, back, recall, beep, clear, enter, change sign (CHS), accuracy, undo, relocate, scroll and transpose. The following discussion will describe the preferred functions and operations associated with each of these keys.

The ON/OFF key turns the instrument ON or OFF. Press this key and the last selection appears on the display screen. If the user wants that selection, he/she need not press any other key. In the preferred instrument, power is provided by replaceable or rechargeable batteries but can also be a/c for instruments fixed to the drawing boards.

The MENU key changes a selection. When pressing the MENU key the information box gives the following options: SET (blinking), FIND and ENGINEERING APPLICATIONS (ENG. APPLIC.).

The SCAN key preferably includes four arrow heads, one for each direction, and selects an option or scrolls through existing files. The SCAN key also moves cursors on the display screen.

The ENTER key accepts a desired selection. In order to move the cursor quickly, the SCAN and ENTER keys may be pressed simultaneously.

The RECALL key recalls any previously stored file.

The CONVERT key converts any format, mode, unit, or scale into another in conjunction with the information box at any time after entering any angle, scale, or any unit of measurement. The scale may be converted at any time.

The BACK key makes any input correction. If pressed more than once it goes back to the previous step.

The CLEAR key clears the display screen. The CHS key (change sign) changes the sign of angles. The ACCURACY key sets the accuracy of either the scales or the angles preferably using an information box to enter the desired accuracy. The UNDO key allows the user to undo the last operation performed. The RELOC key allows the user to relocate the origin of the scale. The display screen electronically scrolls the scale, as the user relocates the origin using the RELOC key. The SCROLL key allows the user to turn the scroll feature on or off.

The TRANSPOSE key allows the user to invert the scale shown by the display screen without rotating the instrument. The number of keys on the instrument is determined by the number of operations offered by the particular instrument.

In general, when a key is pressed, the information box preferably provides a menu system with several alternatives. The first alternative appears blinking. If that alternative is the desired one, the user presses the ENTER key and a new information box appears. If the user wants to change the selection, he/she presses the appropriate SCAN key to move to a new selection. That new selection will then blink and the user accepts it by pressing the ENTER key. This menu system is used in other embodiments as will be described below.

The invention, in the ruler 100 embodiment or in other embodiments, can perform many specific functions and tasks in combination with the various preferred keys which will be described in more detail later.

RULER WITH VERTICAL SLIDING RULE

Figure 9A:
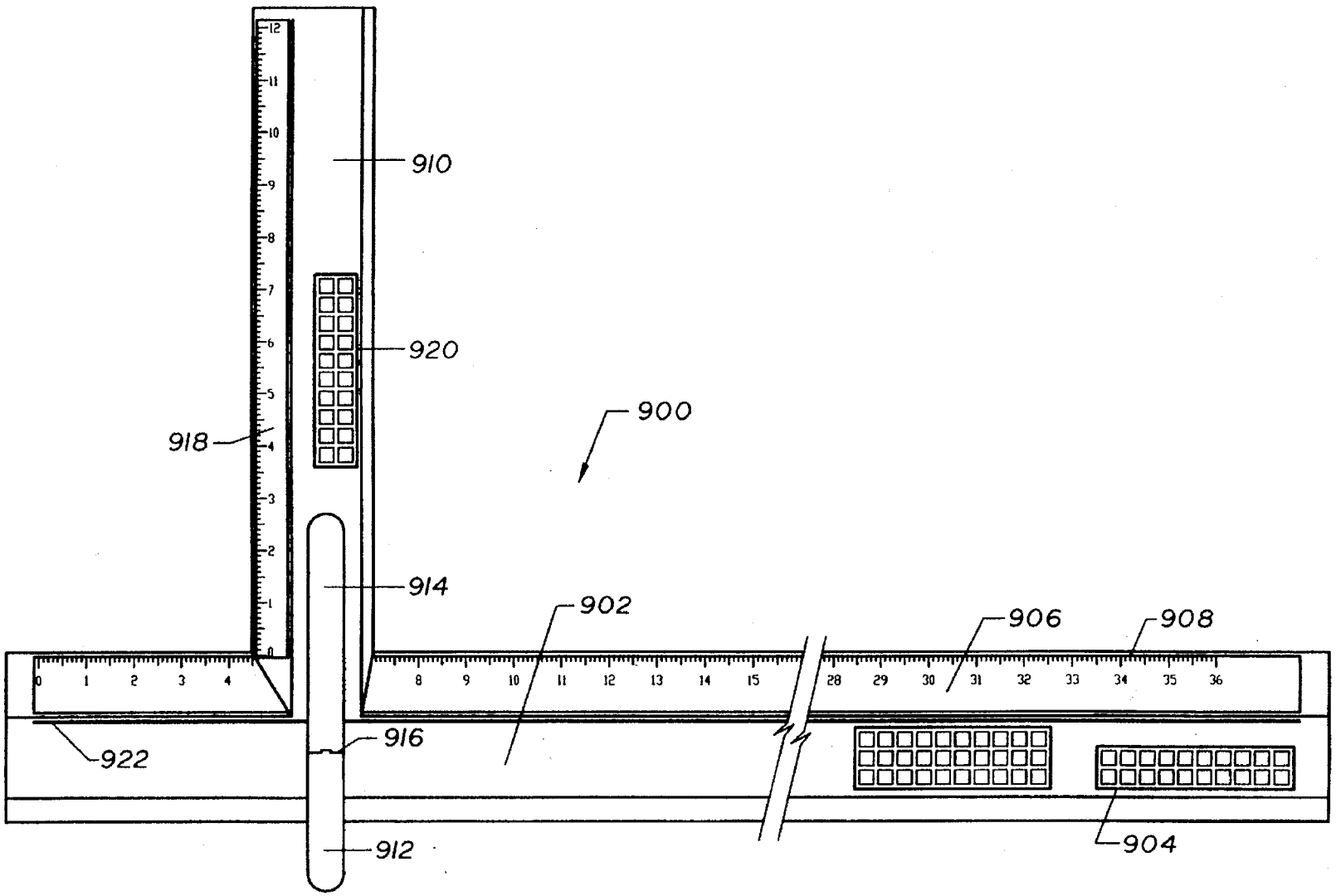
FIG. 9*a* is a top view of an embodiment of the invention configured as a ruler with a vertical sliding rule.
Figure 9B:
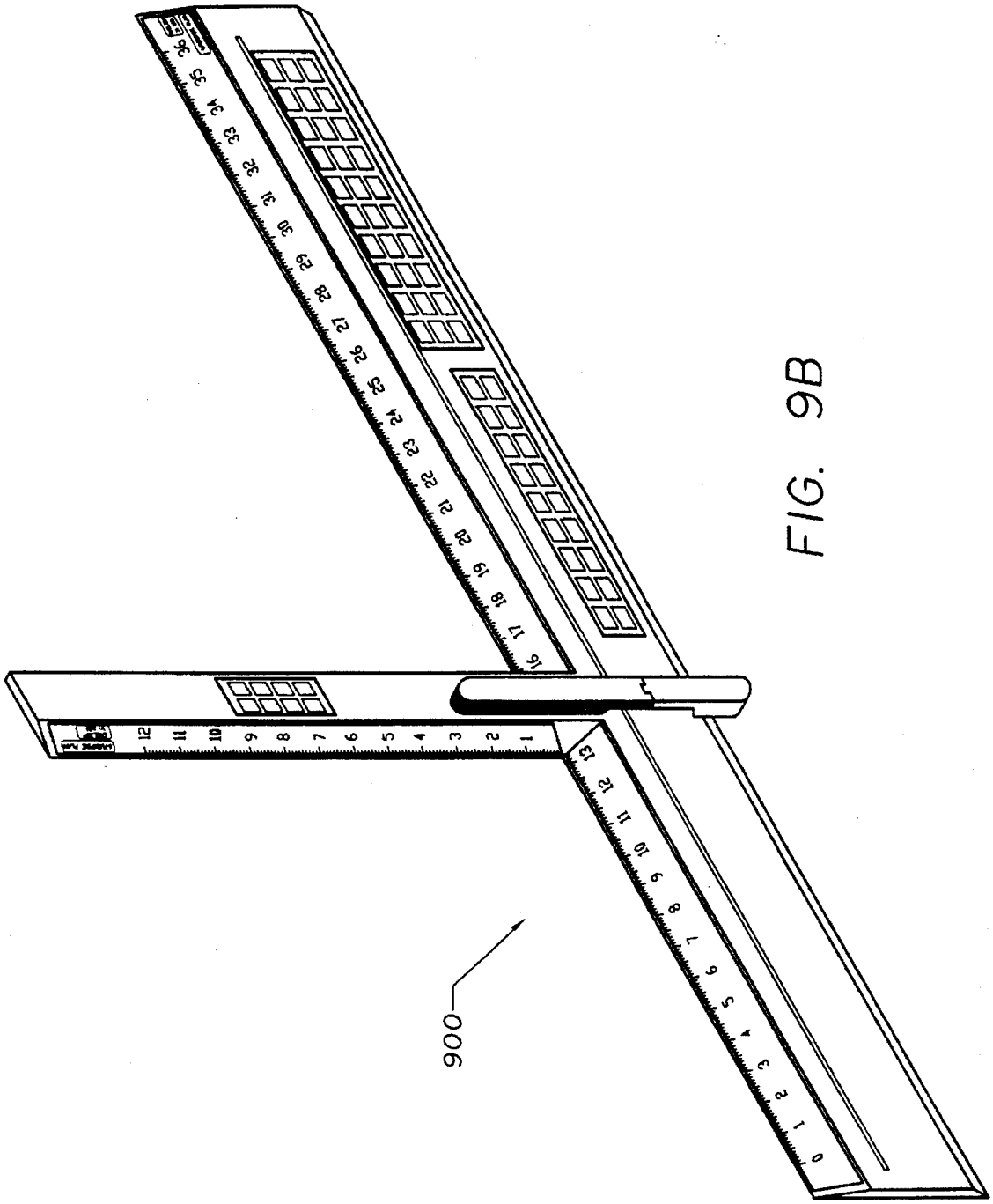
FIG. 9*b* is a perspective view of the ruler with vertical sliding rule.
Figure 9C:
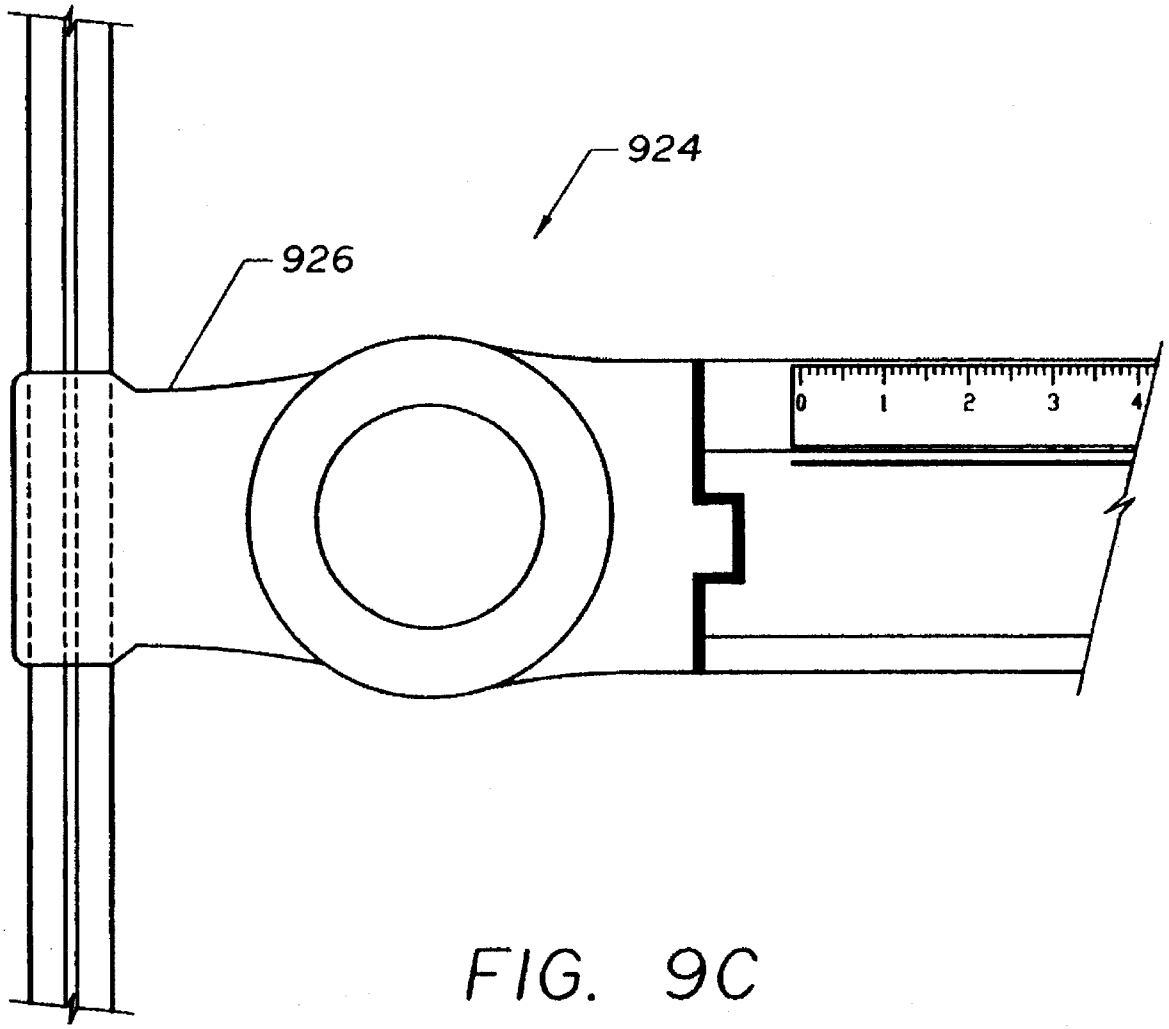
FIG. 9*c* is a top view of an embodiment of the invention with a pivoting module.

FIGS. 9*a*, 9*b* and 9*c* show an alternate embodiment for the invention comprising a ruler with sliding vertical rule 900. These figures show an instrument for right handed users, but a left handed version may also be available. This embodiment comprises a horizontal member 902, similar to the aforementioned ruler 100 shown in FIG. 1*a*, possessing a horizontal member keyboard 904 and a horizontal member display screen 906 which may contain a graphically represented scale 908. This embodiment additionally contains a vertical member 910 which is slidably attached to the horizontal member 902 via a sliding module 912 and a pivoting arm 914. The sliding module 912 rests on bearings (not shown) that allow movement only in the horizontal direction. The sliding module is manipulated by a handle which provides comfort without interfering with its operations.

In the preferred embodiment, the vertical member 910 can be manually raised from the drawing table by using a hinge 916. The construction of this vertical member may be similar to ruler 100 as discussed above, and includes a cavity, processing electronics (not shown) in the cavity, bearing mechanisms (not shown), a vertical member display screen 918 and, optionally, a user input device such as a vertical member keyboard 920. The preferred embodiment also possesses a means, such as a digitizing band 922, to identify the position of vertical member 902. The digitizing band 922 is located along the length of the top surface of the horizontal member 902 and beneath the sliding module 912. The digitizing band is read by the sliding module using a reading sensor.

The vertical member keyboard 920 may be omitted in this preferred embodiment by incorporating its functions into the horizontal member keyboard 904 with appropriate electrical connections.

Figure 27:
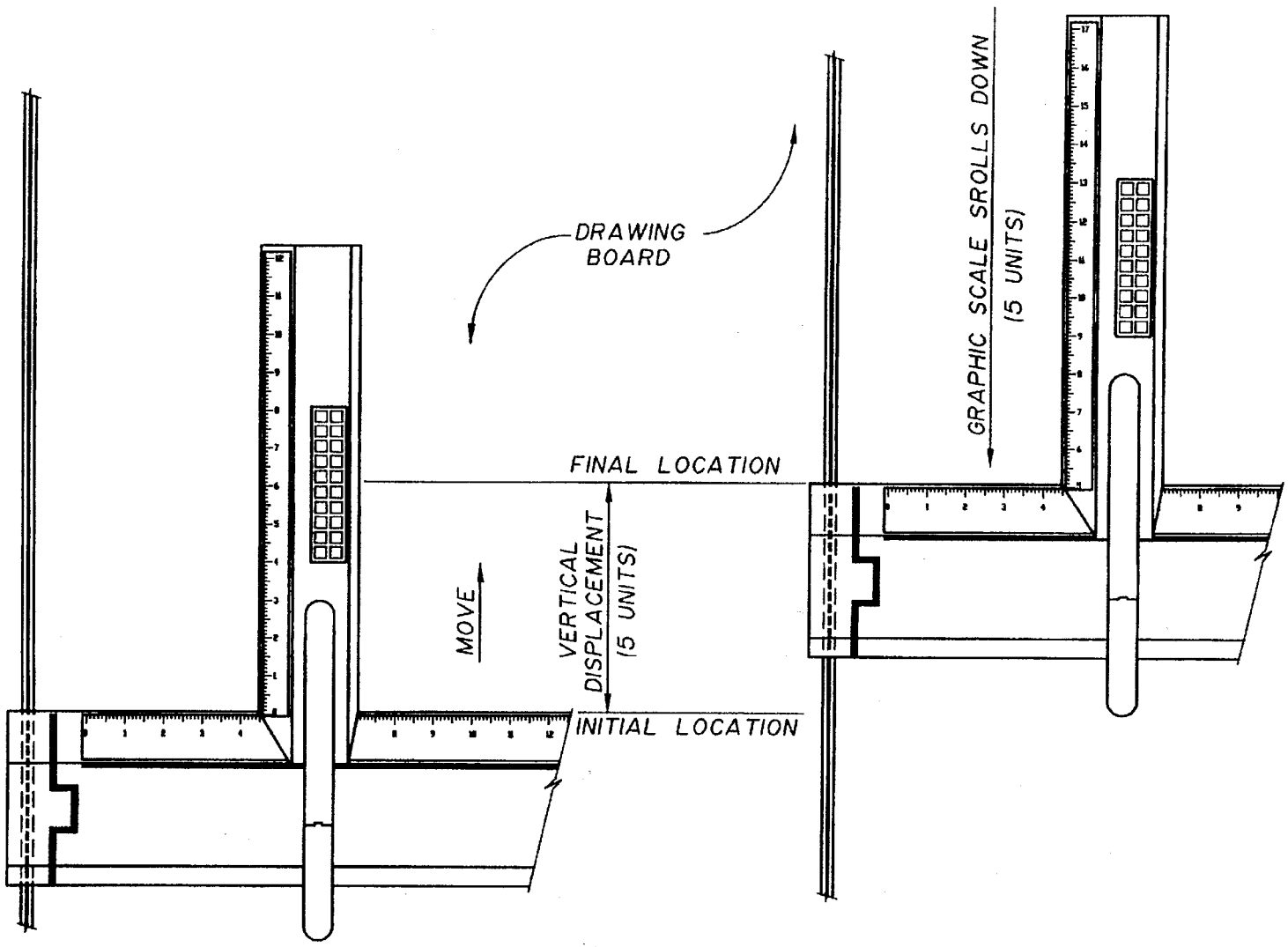
FIG. 27 is a top view of a ruler with a vertical sliding rule showing the electronic scrolling feature in the vertical member display screen.

This embodiment can move independently over a two dimensional surface, such as an engineering drafting board. The display screens 906 and 918 are electronically controllable, as described above, and display an electronically scrolling screen as the body moves. FIG. 27 shows the electronically scrolling screen of the vertical member display screen 918.

OPTIONAL GUIDING MECHANISMS

In certain applications possibly requiring a high level of precision, another alternate embodiment envisions a ruler such as shown in FIG. 1*a* or a ruler with sliding vertical rule shown in FIGS. 9*a* and 9*b*, used in conjunction with some form of a guiding device or structure. For example, in applications requiring precise horizontal orientation of the present invention the guiding structure can maintain that orientation more consistently than manual movement by the user. If the guiding device or structure is used with a ruler, the apparatus is known as a parallel rule attachment.

With a guiding mechanism, the preferred embodiments may also have a pivoting module 924 as shown in FIG. 9*c*. The pivoting module has a sliding block 926 and a pivot 928.

Figure 11:
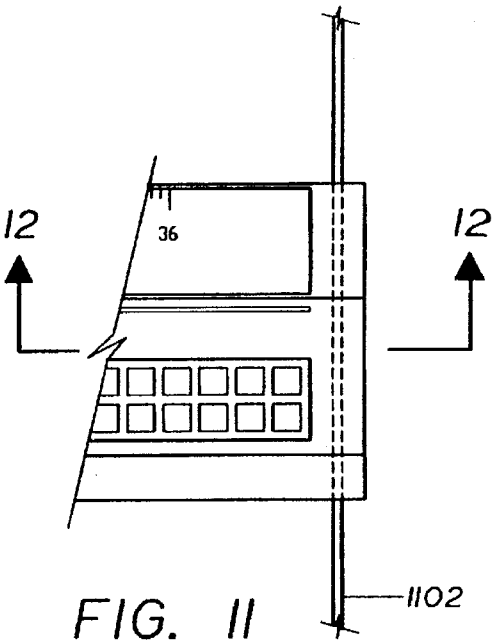
FIG. 11 is a top view of an auxiliary guide rail at the right side of a ruler body.
Figure 10:
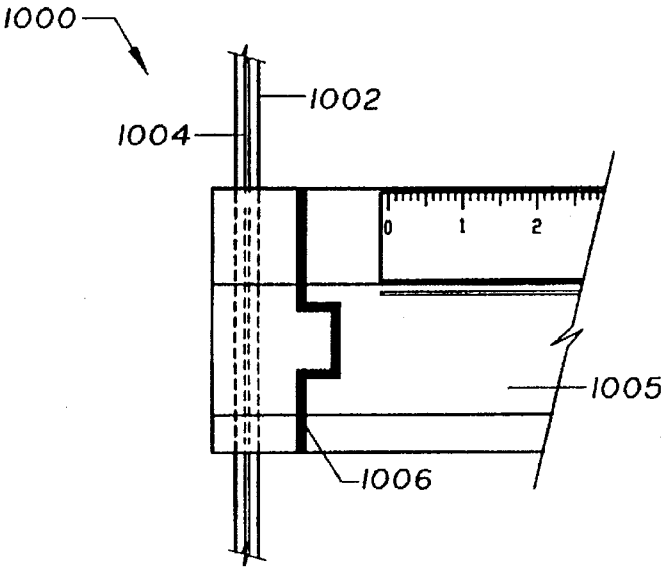
FIG. 10 is a top view of a main guide rail and hinge at the left end of a ruler.
Figure 12:
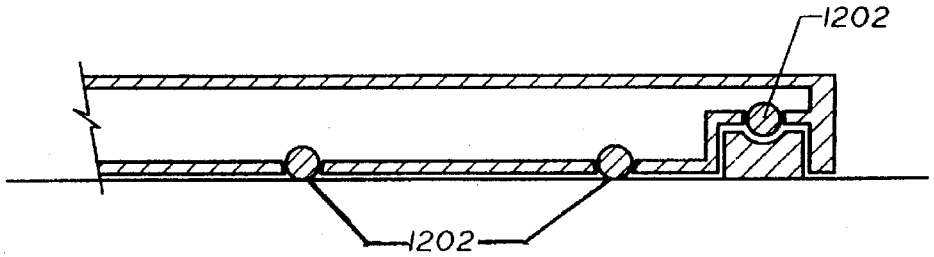
FIG. 12 is a cross-sectional view of a connection to an optional auxiliary guide rail.
Figure 13:
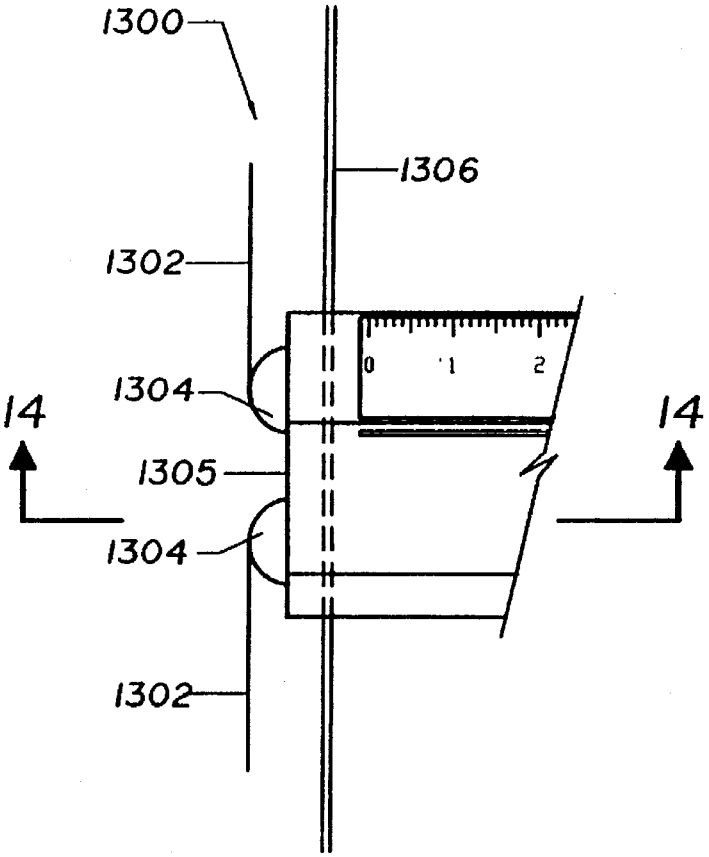
FIG. 13 is a top view of a cord/pulley system used as a guiding mechanism.

Two possible preferred embodiments of the guiding structure include a vertical guide rail mechanism 1000, shown in FIGS. 10 and 11, or a cord/pulley system 1300, shown in FIG. 13. In FIG. 10, the embodiment is shown slidably attached to a left main vertical guide rail 1002. A digitizing band 1004, located on the top or on the inner side of the main vertical guide rail 1002, registers the vertical distance moved by the body 1005. The digitizing band 1004 may alternatively be located on the drawing board. The digitizing band 1004 is an optional alternative to measuring bearings. A hinge 1006 is included to lift the body 1005 off the drawing surface by the user. In this embodiment, the right side slidably attaches to an optional auxiliary guide rail 1102 to provide additional rigidity, as shown in FIG. 11. The cross-sectional view of the connection of the body 1005 to the auxiliary guide rail 1102 is shown in FIG. 12 with a preferred arrangement of bearings 1202. When the auxiliary guide rail is not included, a rotation module, preferably on the horizontal member can be provided to the left of the vertical member.

Alternatively, the guiding means may be a cord/pulley system 1300 as shown in FIG. 13. The embodiment shows cords 1302 connected to the pulleys 1304 in the body 1305. A digitizing band 1306, located on the surface of the drawing board, enables the apparatus to accurately determine the vertical displacement of the horizontal member.

Figure 14:
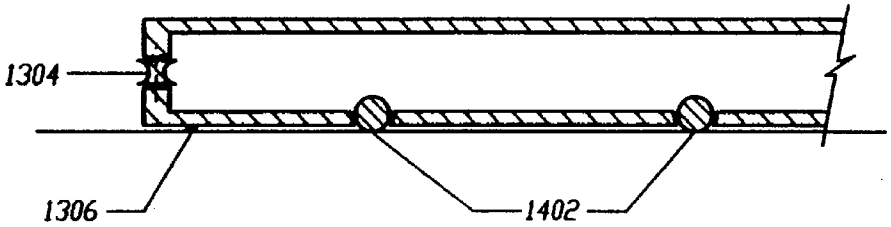
FIG. 14 is a cross-sectional view of the cord/pulley system.

FIG. 14 shows preferred placements for bearings 1402 in the instrument in a configuration with the cord/pulley guide system of FIG. 13.

DRAFTING TRIANGLE

Figure 15A:
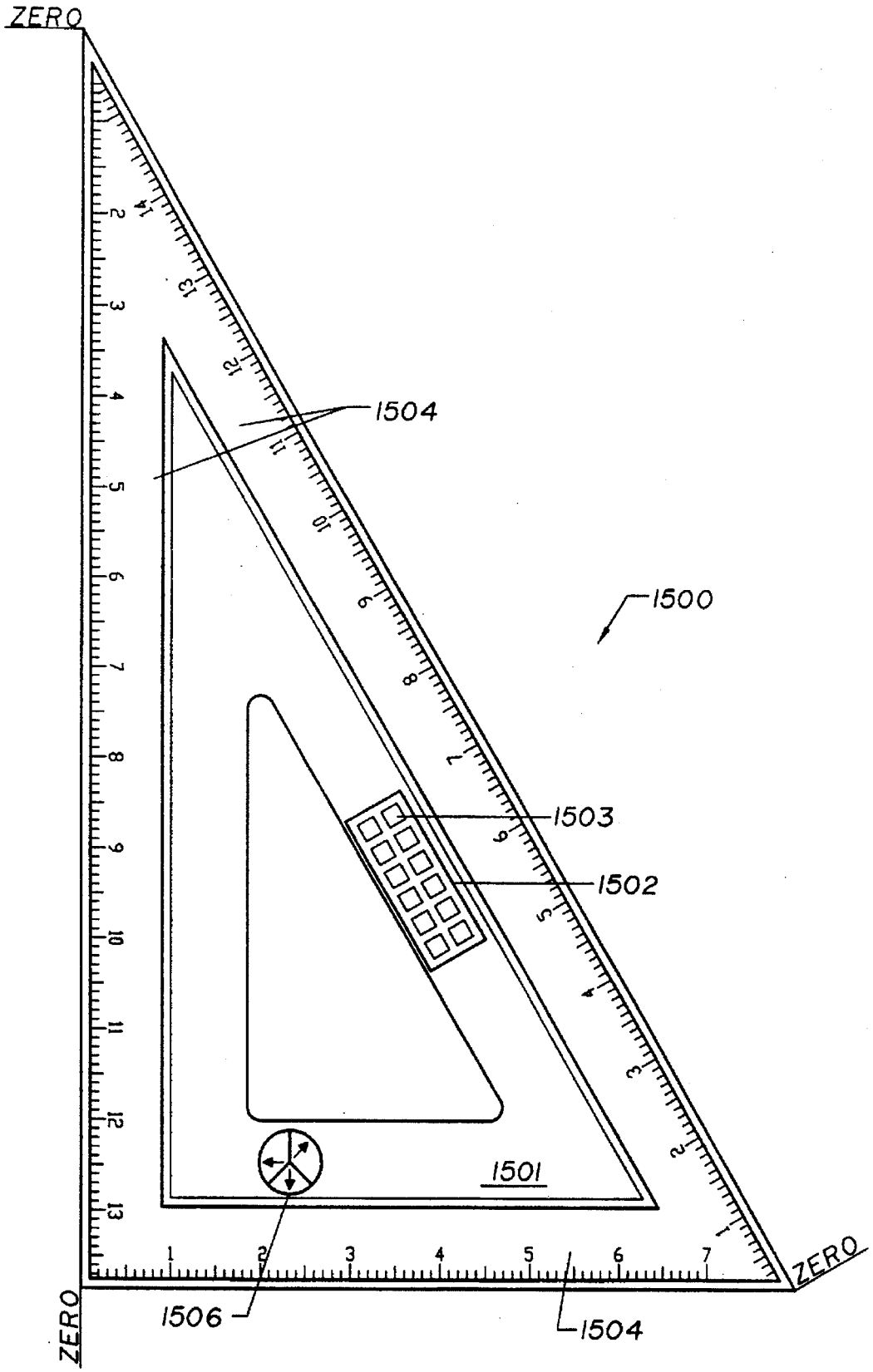
FIG. 15*a* is a top view of an embodiment of the invention configured as a 30-60-90 drafting triangle.

FIG. 15*a* shows yet another alternative embodiment of the invention including a drafting triangle 1500. While this embodiment could include drafting triangles of any size or shape, the most useful shapes are 45° (shown in FIG. 20) or 30° triangles (shown in FIG. 15*a*). This embodiment is preferably constructed in a similar manner as that of the ruler 100 shown in FIG. 1*a*. Specifically, this embodiment has an internal cavity (not shown) containing processing electronics (not shown), as well as bearing mechanisms (not shown) to control and measure the displacement of the triangle 1500 as it moves.

As shown in FIG. 15*a*., the top surface 1501 of the drafting triangle 1500 has an input mechanism, such as a keyboard 1502 with keys 1503. In this embodiment, display screens 1504 are proximate to each of the three edges of the triangle. As in the ruler 100, shown in FIG. 1*a*, the display screens 1504 are suitable for graphical representation of a scale, or other desired information. When displaying a scale, the display screens 1504 can electronically scroll. When a particular scale on a display screen 1504 is reset, the origin is preferably located at the corner, but may be relocated by the user as previously described. Furthermore, so that the user may activate any of the three display screens independently, the body preferably includes scale selection keys 1506.

Of course, other embodiments of this design need not have display screens 1504 on all sides, but preferably have at least one. This embodiment may optionally have a calculator feature, including an input means such as a calculator keyboard (not shown). In the preferred embodiment, calculation results are shown in the display screen 1504 adjacent to the calculator keyboard.

PROTRACTOR

Figure 15B:
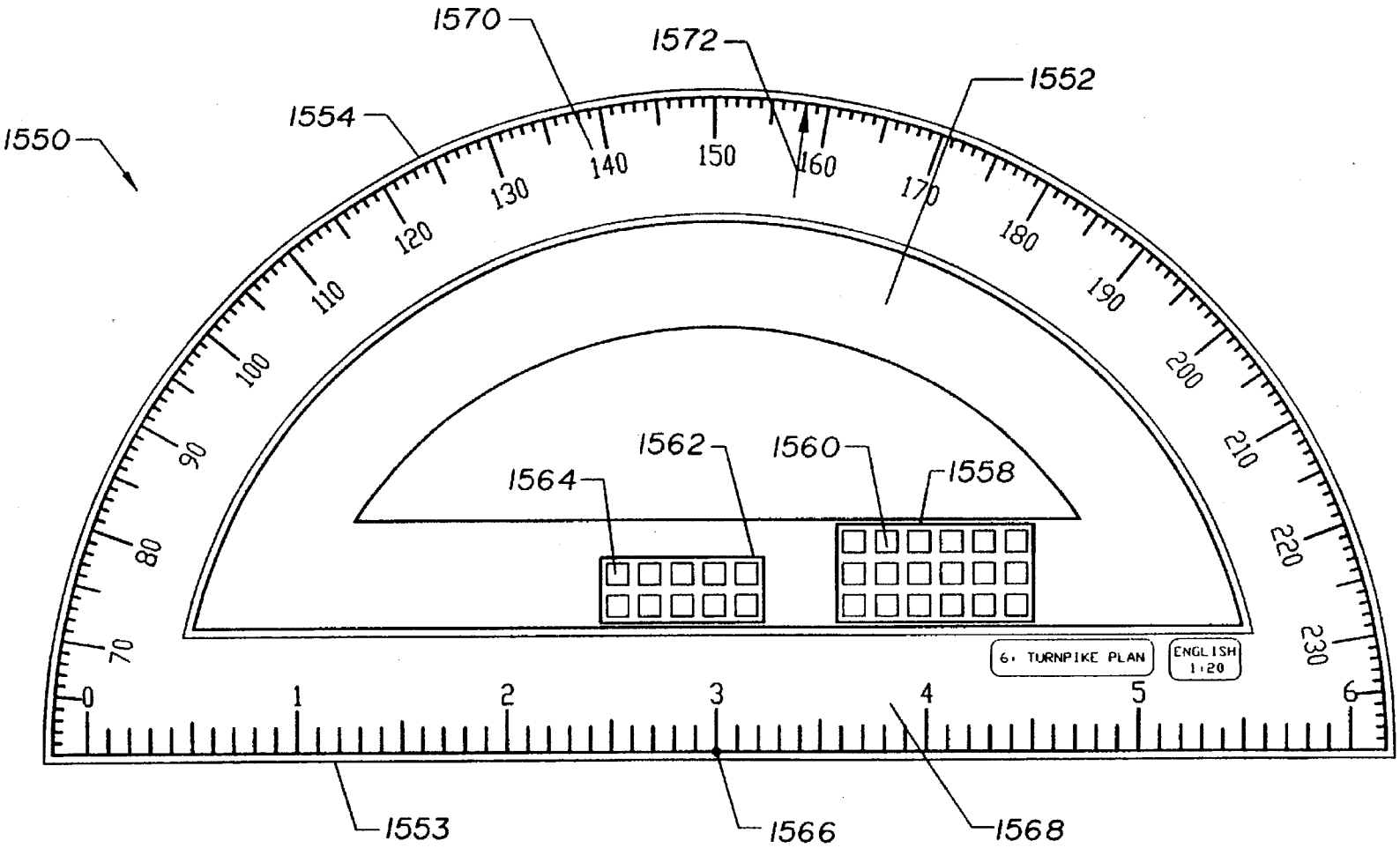
FIG. 15*b* is a top view of an embodiment of the invention configured as a protractor.
Figure 15C:
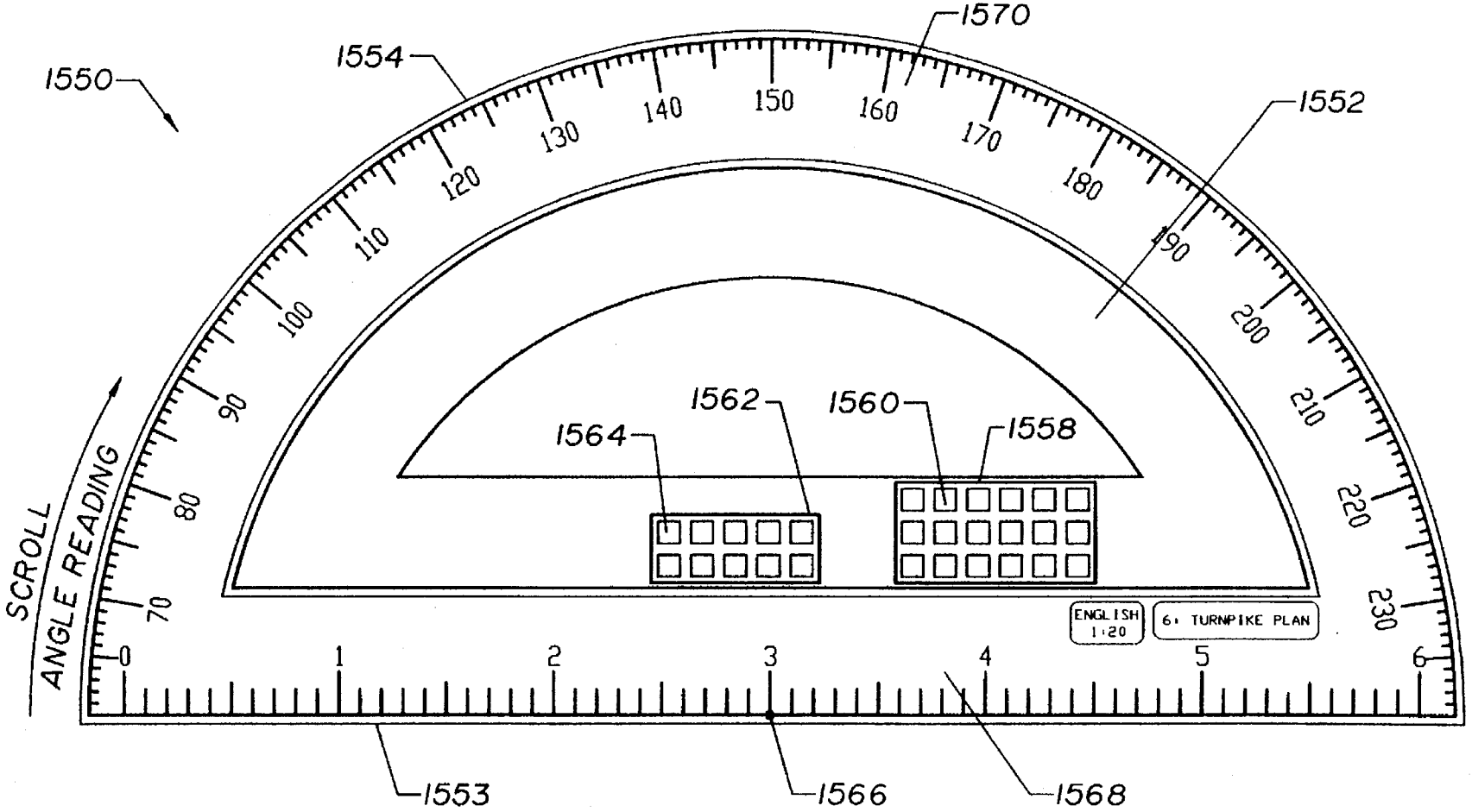
FIG. 15*c* is a top view of a protractor with the display screen scrolling the angle.

The invention may be configured as a protractor 1550 as shown in FIG. 15*b*. This embodiment is similar to the ruler of FIG. 1*a* and includes a body 1552, a straight edge 1553, a complete circular or semicircular curved edge 1554, optional bearing mechanisms 1555 (not shown), processing electronics 1556 (not shown), a keyboard 1558 with keys 1560, an optional calculator keyboard 1562 with keys 1564, a center mark 1566, a straight display screen 1568, and a curved display screen 1570 along the semicircle or circle. The display screens 1568 and 1570 are preferably suitable for graphical representation to allow the display of items such as scales, cursors, and information boxes as previously described. Scales might electronically scroll as a result of relocating the origin or of movement of the body 1552 (FIG. 15*c*), as previously described.

To measure an angle with this embodiment, the center mark is aligned at the vertex of an angle such that the edge 1553 is along one line forming the angle (or along the horizontal). The user then activates a cursor 1572 in the curved display screen 1570 and, using the appropriate scan keys, position the cursor 1572 at the intersection of the remaining line and the semicircular curved edge 1554. The instrument determines the position of the cursor 1572, and the processing electronics calculates the angle measured. This angle is displayed in an information box. Alternatively, the user may key in the angle value and the display screen will show by means of a cursor the angle so that any angle range can be displayed.

The edge 1553 of the body 1552 need not be aligned with one of the lines forming the angle. Instead, two cursors could be activated and positioned as described above. The processing electronics 1556 determines the angular difference and displays the result in an information box.

The bearing mechanisms 1555 in connection with the previously described features of this embodiment provide extremely versatile instrument. The bearing mechanisms 1555 measure the horizontal and vertical displacement components, and the straight display screen 1568 might correspondingly electronically scroll as previously described. Because the protractor 1550 possesses the straight edge 1553 and the straight display screen 1568, many additional functions can be performed, including those functions described in connection with the ruler 100 of FIG. 1*a*.

The invention can operate with angles using the menu system in a variety of ways and preferably operates as follows. To select an angular format once the instrument is turned on and the menu is activated, a user presses the scan key to select and enter the angle option by positioning the blinking cursor over this option. At this point, the desired angular convention is selected, i.e., sexagecimal or centecimal (degree or grade), then the format could be selected using the scan key and to highlight the desired format which might include DDS, DMS or RAD. Once an angular format is selected, the instrument displays that format on the right side of the information box to remind the user of the current angular format. If DMS is chosen, the instrument uses a blinking prompt to each field (degrees, minutes, and seconds) of the angle. After each field is entered, the scan key is used to move to the next field.

Once an angle is entered, the instrument gives the option of accepting that angle or choosing to perform arithmetic operations such as addition or subtraction. If an arithmetic operation is chosen, the second angle is entered in a similar fashion as the first. After the second angle is entered, the result is displayed. This result may be accepted by the user, or another operation may be performed.

To change the format of the angle, one enters an angle as previously described. Upon accepting the angle, the instrument prompts for format or mode of measuring the angle. If format is chosen, options include angular formats such as DDS, DMS or RAD. If mode is selected, the options of angle, bearing, or azimuth might be available.

Figure 15D:
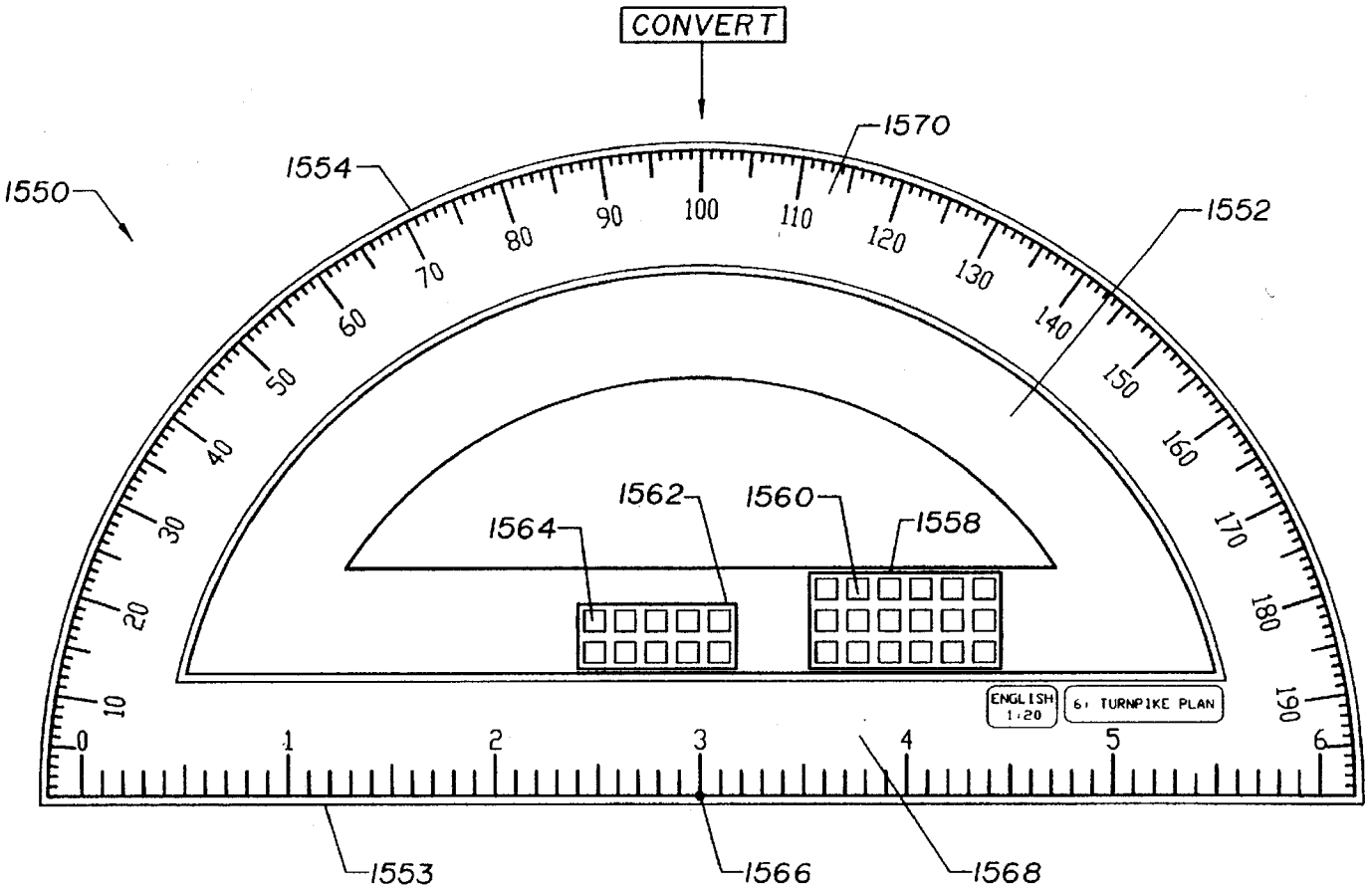
FIG. 15*d* is a top view of a protractor with the display screen converted from the sexagecimal to the centecimal angle system.
Figure 15E:
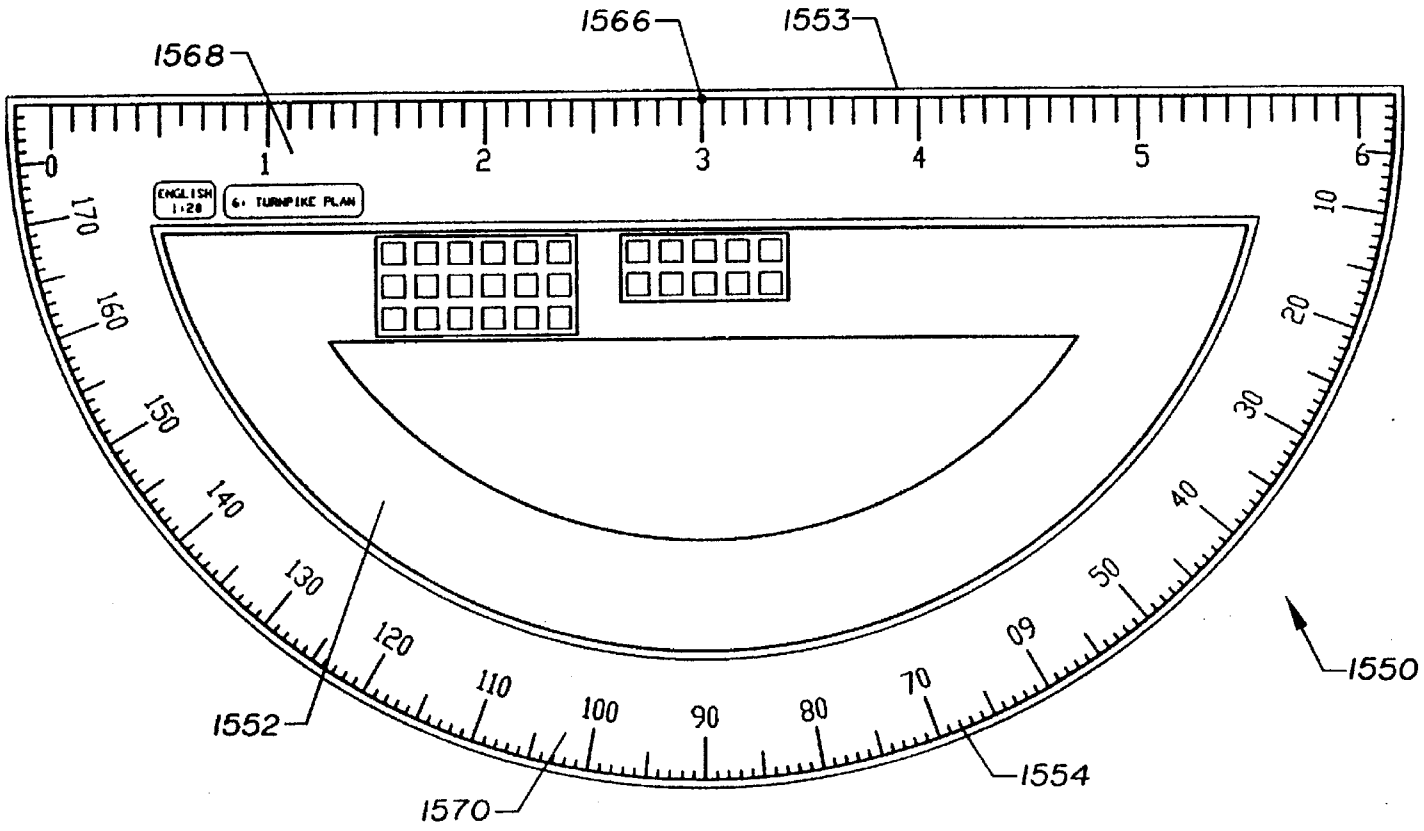
FIG. 15*e* is a top view of a protractor with the scale in the display screen transposed.

The preferred embodiment uses standard sign conventions for angular and azimuth mode: the angle increases clockwise unless the CHS Key is pressed and azimuth increases if rotated clockwise or decrease if rotated counterclockwise. The CHS key reverses these conventions. When using the azimuth mode, the Base Line is preferably the True North Line as it appears on the plans. The quadrant and direction of a line are implicit when using bearing notation; once a bearing has been entered, the value increases or decreases according to the standard bearing convention. When using the bearing mode, the base line's bearing is selected by the user on the instrument. Conversion from sexagecimal (degrees) to centecimal (grade) can be done instantly by pressing the CONVERT key, see FIG. 15*d*. Also by pressing a TRIG key, the user can read the value of the sine, cosine, tangent and cotangent for the selected angle in an information box. Likewise, the angle reading can be transposed in the same fashion as with scales as shown in FIG. 15*e*.

INCLINATION GAUGE

Figure 16:
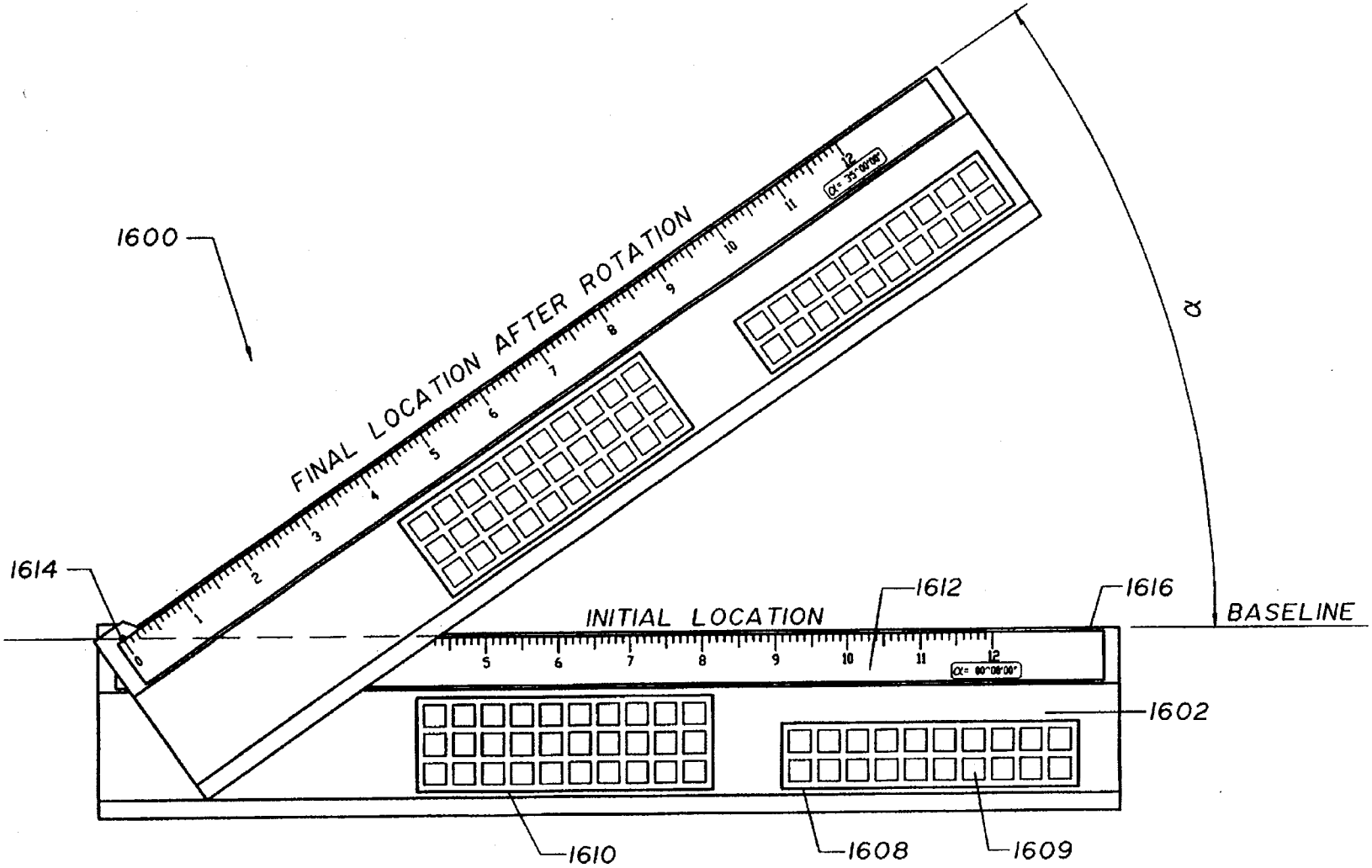
FIG. 16 is a top view of an embodiment of the invention configured as a inclination gauge.

Another possible embodiment is an inclination gauge 1600 shown in FIG. 16 which generally shares the design and features with the ruler 100, shown in FIG. 1*a*. This embodiment includes a body 1602, bearing mechanisms 1604 (not shown), processing electronics 1606 (not shown), a keyboard 1608 with keys 1609, an optional calculator keyboard 1610, and a display screen 1612 which is of a type suitable for graphical representation. This embodiment additionally includes a pivoting pin 1614 ordinarily contained within the body 1602. When manually depressed, the pivoting pin 1614 preferably pierces and fastens into a drafting board. Although the pivoting pin 1614 may be located anywhere on the body 1602, except at the bearing mechanisms 1604, the pivoting pin 1614 is located at the top left corner of the body 1602 in the preferred embodiment.

To measure an angle with this embodiment, the user aligns the edge of the inclination gauge along one line segment of the angle such that the pivoting pin is located at the corner of the angle. The pivoting pin is depressed thereby fixing that point at the vertex of the angle. The angular reading is reset to zero by an appropriate key 1609 in the keyboard 1608. Then, by rotating the instrument about the axis defined by the pivoting pin so that the edge 1616 is aligned with the other line forming the angle, the user reads the angle from the display screen 1612.

Internally, the processing electronics (not shown) converts the distance recorded by a measuring bearing located at the non-pivot end of the ruler to an angular displacement using a calibration factor. This calibration factor is derived from the distance measured by the bearing mechanisms 1604 on the end of the instrument away from the pivoting pin 1614 as the instrument is rotated divided by the distance between the bearing mechanism and the pivoting pin 1614. Of course, angles can be displayed in any desired angular unit, including degrees, radians, or grades (a military angular measure wherein a circle is divided into 400 units). In addition, angles can be expressed as a slope. The instrument is able to operate with angles in a similar fashion as previously described.

To operate the inclination gauge with the angle already set and the instrument aligned with a base line, the user fixes the pivoting pin and rotates the instrument to another line and the information box shows the angle in the appropriate format or mode. The angle will not change until the pivoting pin is fixed.

The inclination gauge embodiment may also be used as a slope gauge. The traditional method involves using two different scales, vertical and horizontal, then requires the user to plot a slope or grade somewhere on the plan and transport it to the point of origin using two drafting triangles. Even though this method is error prone and time consuming, it is still a common process in modern design work.

In the preferred embodiment, this task is performed in the following steps. First, the appropriate horizontal and vertical scales are set. Then, the grade is entered by either directly entering the value, or the processing electronics calculates the value from entered elevation and distance of the incline. After the horizontal grade is set to zero, or the value of a known grade is entered, the instrument is aligned with this line of known grade. Finally, when the instrument is fixed using the pivoting pin, the instrument is rotated in the necessary direction until the correct slope appears in the information box. At this point, the inclination gauge is properly positioned to draw a line.

The preferred inclination gauge also determines an unknown slope on a drafting chart in a similar manner except that the grade is not entered into the instrument. As the edge of the inclination gauge is aligned with the line whose grade is sought, the grade appears in an information box.

Determining Angles and Slopes with Other Body Types

In several of the previously described preferred embodiments, the invention measures angles and slopes using appropriate trigonometric functions. This general method of measuring is shown with several of the body types in FIGS. 17–21. To measure angles using this method, the user sets a cursor, which is graphically represented in the display screen, over any part of a line and marks the point in the memory. Then, transporting the instrument to a different point along the same line and positioning a cursor at that point, the user then enters this point by pressing the appropriate key on the keyboard. The processing electronics calculates both the horizontal and vertical displacements of the line between the two marked points. Furthermore, the processing electronics calculates the angle that this line makes with the horizontal by computing the arc tangent of the vertical displacement component divided by the horizontal displacement component. The menu system preferably guides the user in performing these operations. Furthermore, the instruments preferably operates with angles in a similar manner as has been previously described.

As shown in FIG. 17, with the edge of the ruler aligned with the horizontal, the origin of the scale is located to the left end of line and a cursor is moved to the right end using the scan keys. When the horizontal component is entered, the instrument then prompts the user to align the instrument with the vertical and to measure the vertical component in a similar fashion. This method is indispensable for embodiment without any means capable of measuring displacements such as the measuring bearing mechanisms previously described.

This general method could be used with the ruler with vertical attachment. With this embodiment, rather than realigning the instrument with the vertical, the vertical member is used to measure the vertical component.

Figure 18:
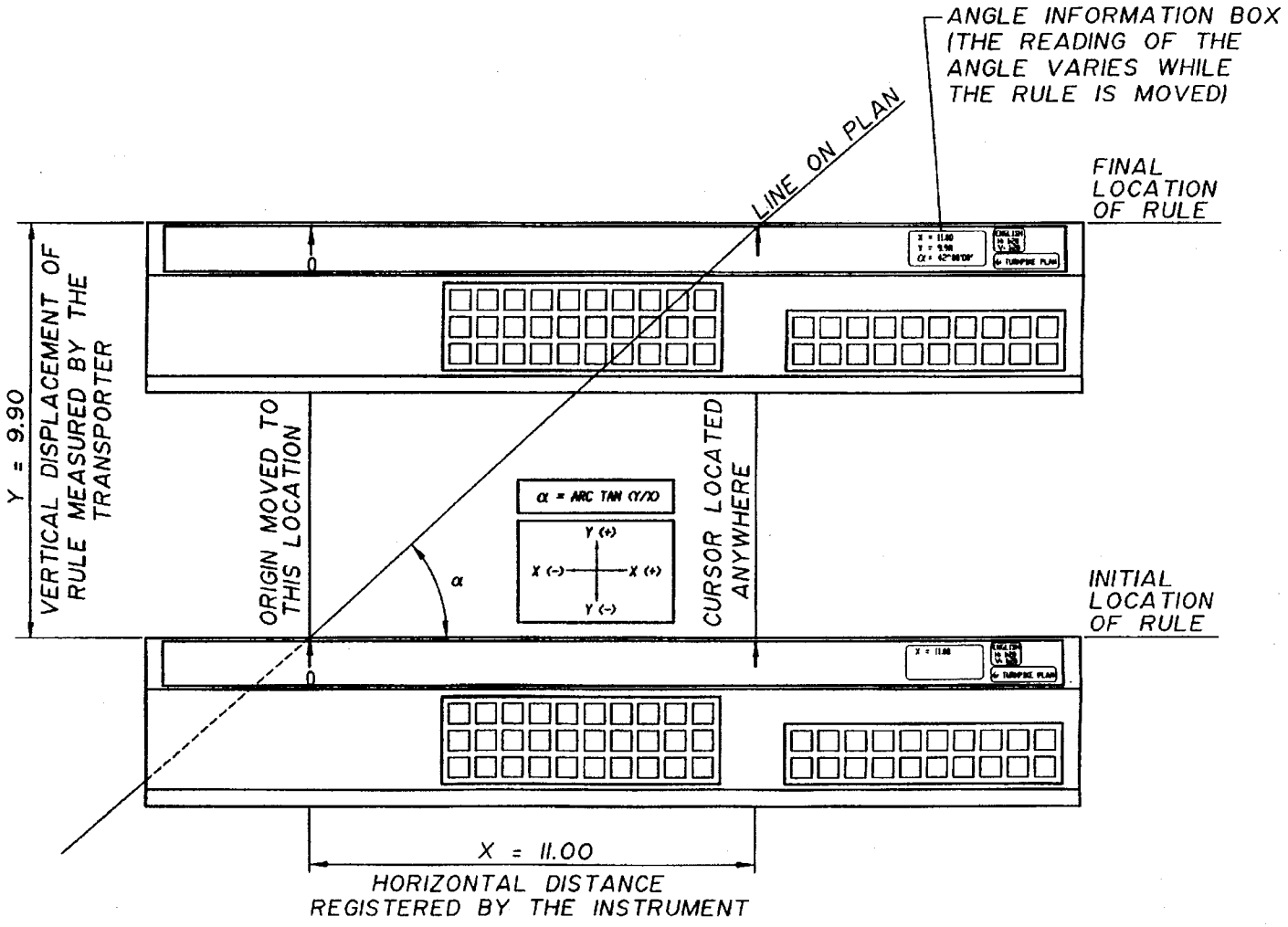
FIG. 18 is a top view of a ruler used to measure an angle in an alternate way.

An alternative method to measure angles is shown in FIG. 18. This method is preferred in applications requiring a guiding mechanism but is also available to embodiments without the guiding mechanism. This procedure comprises the steps of setting the vertical and horizonal scaling factors, selecting the find option from the activated menu, and aligning the edge with the horizontal. The origin of the scale is relocated to the intersection of the line and the instrument edge. The instrument is transported vertically a distance determined by the user such that a cursor is positioned at the intersection of the line and the instrument edge. The instrument internally measures the vertical and horizontal displacement components to calculate the angle.

Figure 19:
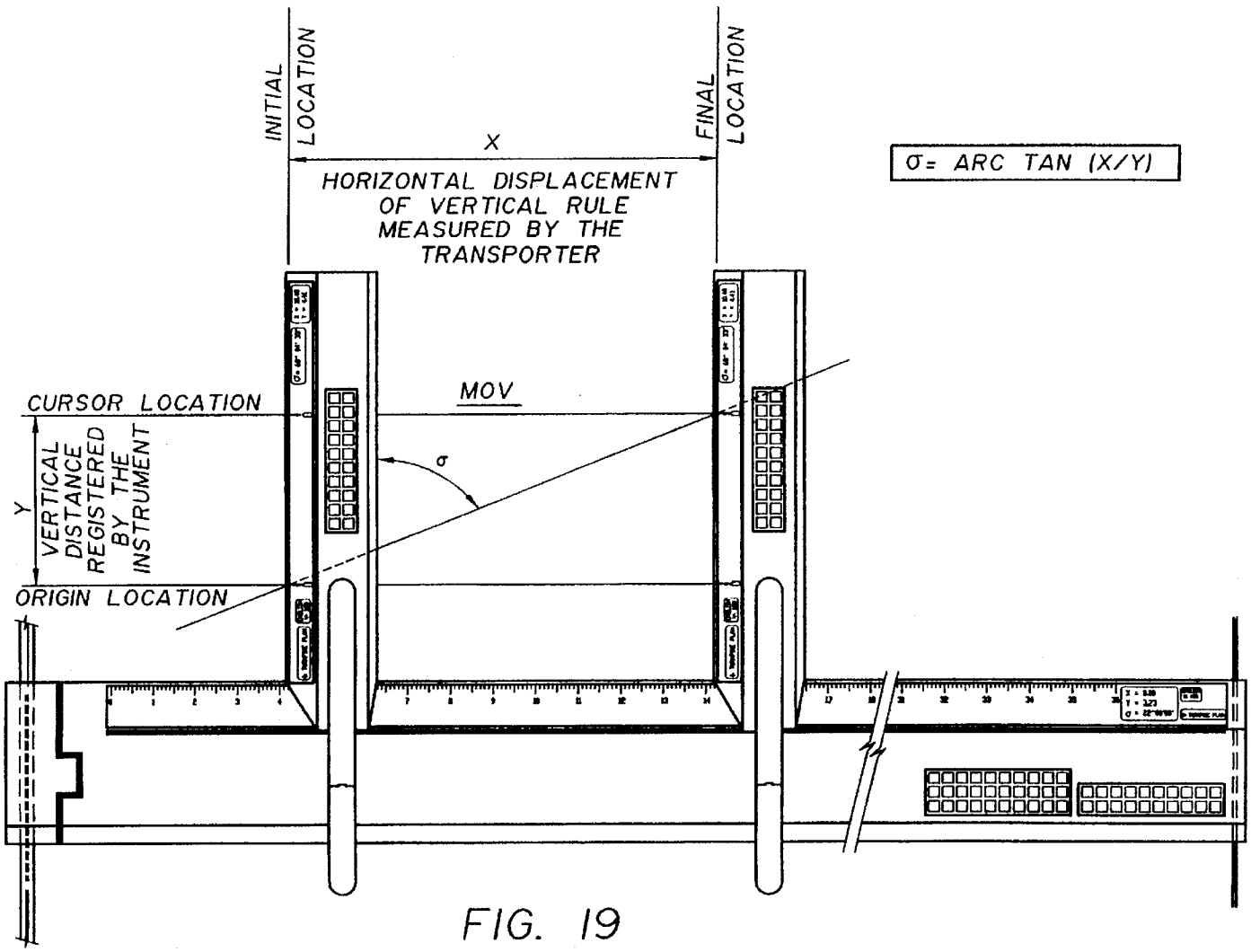
FIG. 19 is a top view of a ruler with vertical sliding rule used to measure an angle.

In a similar fashion, the vertical member of the ruler with sliding vertical rule is preferably used to measure angles as shown in FIG. 19. In this case, the origin of the vertical member scale is positioned at a point near the left end of a line. The vertical member is then moved to the right to position a cursor over the intersection of the line and the edge. The instrument then calculates the angle of the line.

Figure 20:
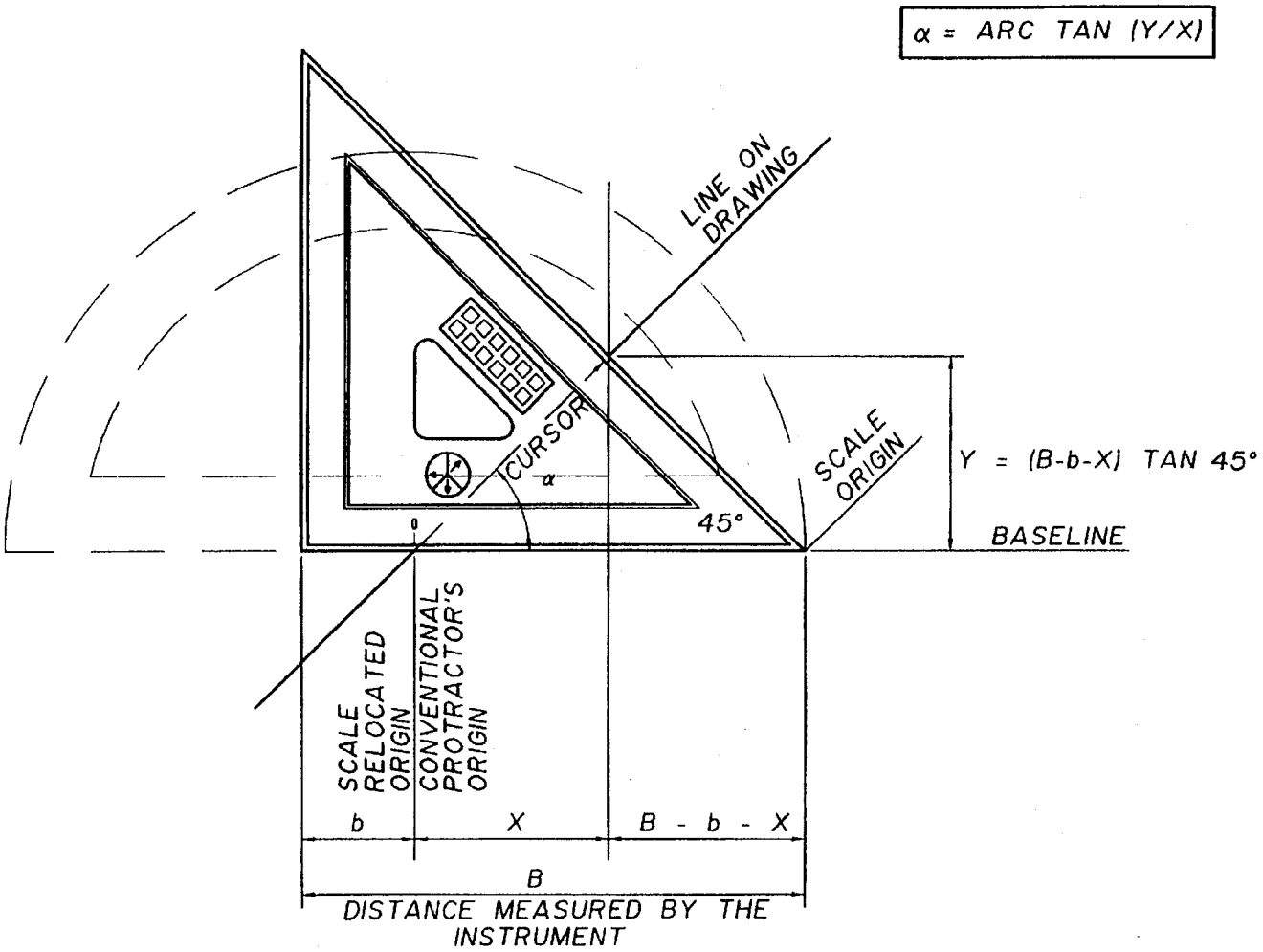
FIG. 20 is a top view of a drafting triangle used to measure an angle.
Figure 21:
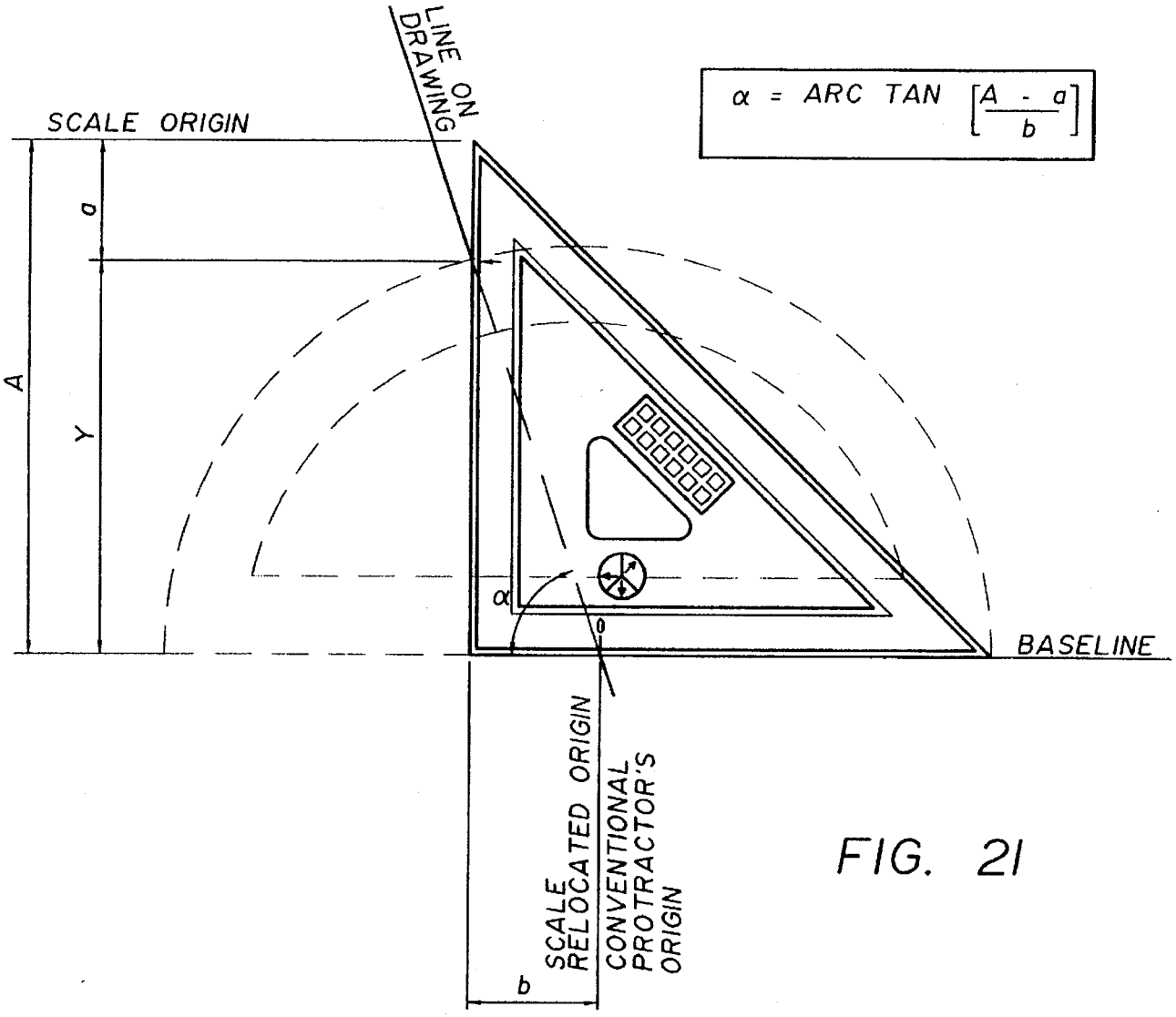
FIG. 21 is a top view of a drafting triangle used to measure an in an alternate way.

The invention embodied as a drafting triangle, with the vertical and horizontal scales properly set, may be easily used to determine the angle of a line on a drafting chart as shown in FIGS. 20 and 21. With an edge of the drafting triangle aligned with the horizontal, the origin of the scale along that edge is relocated to the intersection with the line of interest. Then, using the scan keys, a cursor along either of the two other edges of the drafting triangle is positioned at the intersection of that edge and the line. Once this cursor is entered, the processing electronics calculates the angle.

The different instruments also serve as a slope gauge. The slope gauge helps the designer to instantly plot or find any slope for a road profile or infrastructure utility by simply selecting the SLOPE option from the information box. The user finds or sets a slope using the same criteria depicted for finding or setting angles.

ADDITIONAL FUNCTIONAL EXAMPLES

With these instruments, the user may transport lines to a specific distance by reading the displacement on the display screen. The transporter can be used as an elevation gauge to instantly find the existing elevation on a profile or to locate a fixed elevation. It is necessary to first set the vertical scale with the elevation of a known point, and then slide the instrument up or down.

Figure 25:
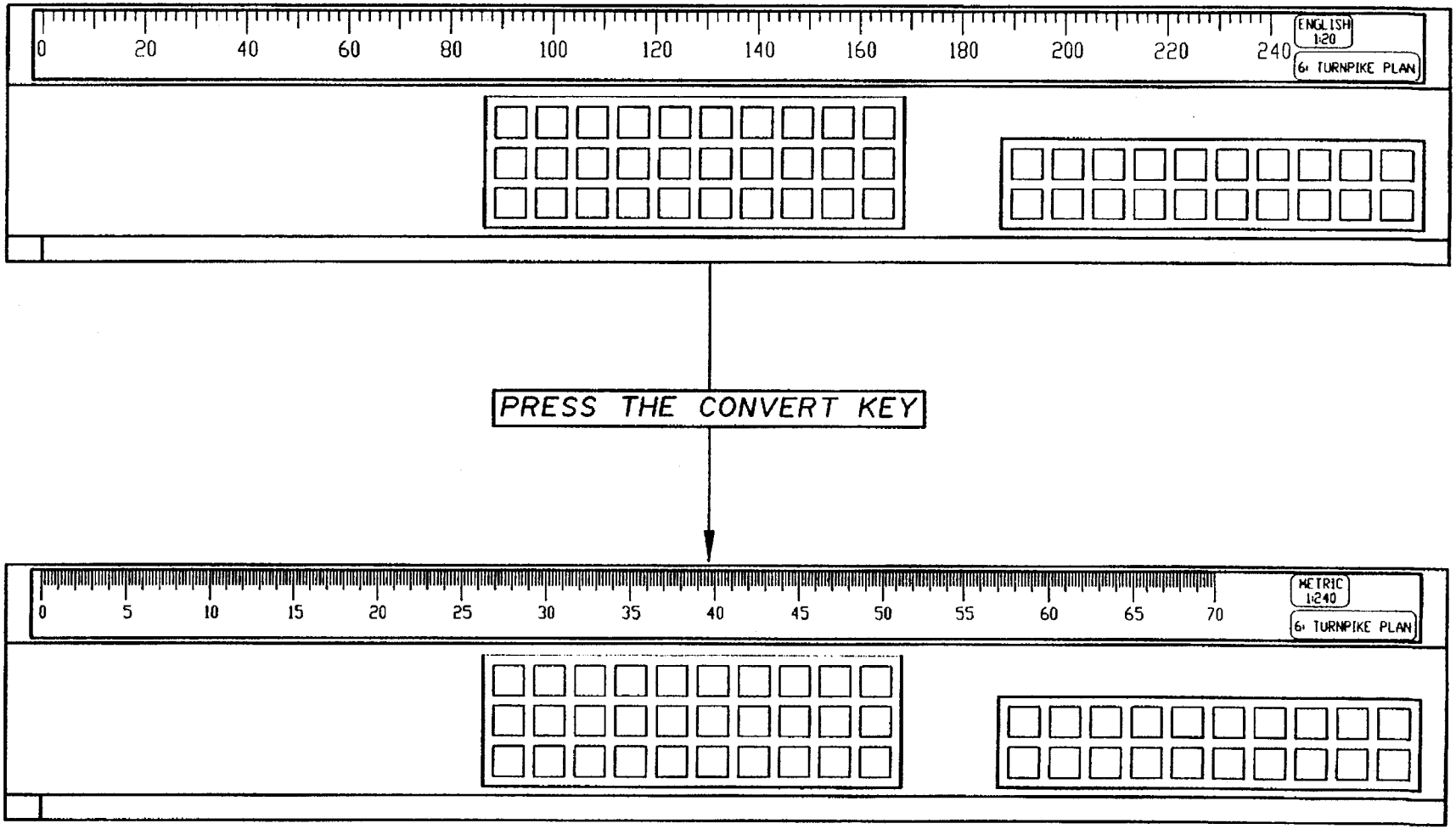
FIG. 25 is a top view of a ruler showing the conversion of a scale for the English Unit System to the Metric Unit System.

As a result of the graphically represented scale in the display screen of the aforementioned embodiments, each of the embodiments is capable of many functions. This graphically represented scale could be used in almost all drafting and non-drafting tools. Each body type can represent the scale in a variety of unit systems, including scales in systems such as the English System, or the Metric System scale as shown in FIG. 25. Of course, scales can be changed utilizing a convert key on the keyboard. Because drafting charts are typically scaled representations of the actual dimensions, the scales represented in the display screen do not need to be of conventional types, but may include scaling factors to convert chart drawings to actual dimensions. These scales, by pressing appropriate buttons, could also be converted from one scale to the next.

The instrument will allow any standard or non-standard scale in any unit system. To set a new scale, the set option is accepted after activating the menu. Following the information provided by an information box, scale is selected and the instrument will prompt the user as to the desired unit system and scaling factor. If the English Unit System is selected, options of Architectural or Engineering format will be prompted before the scaling factor is prompted. The scaling factor is formatted as 1:A where A is a value entered by the user. Once the scale information is selected, this information remains in the scale information box to serve as a reminder to the user. Both horizontal and vertical scaling factors, which may be different, are entered using the information box in this fashion.

Figure 26:
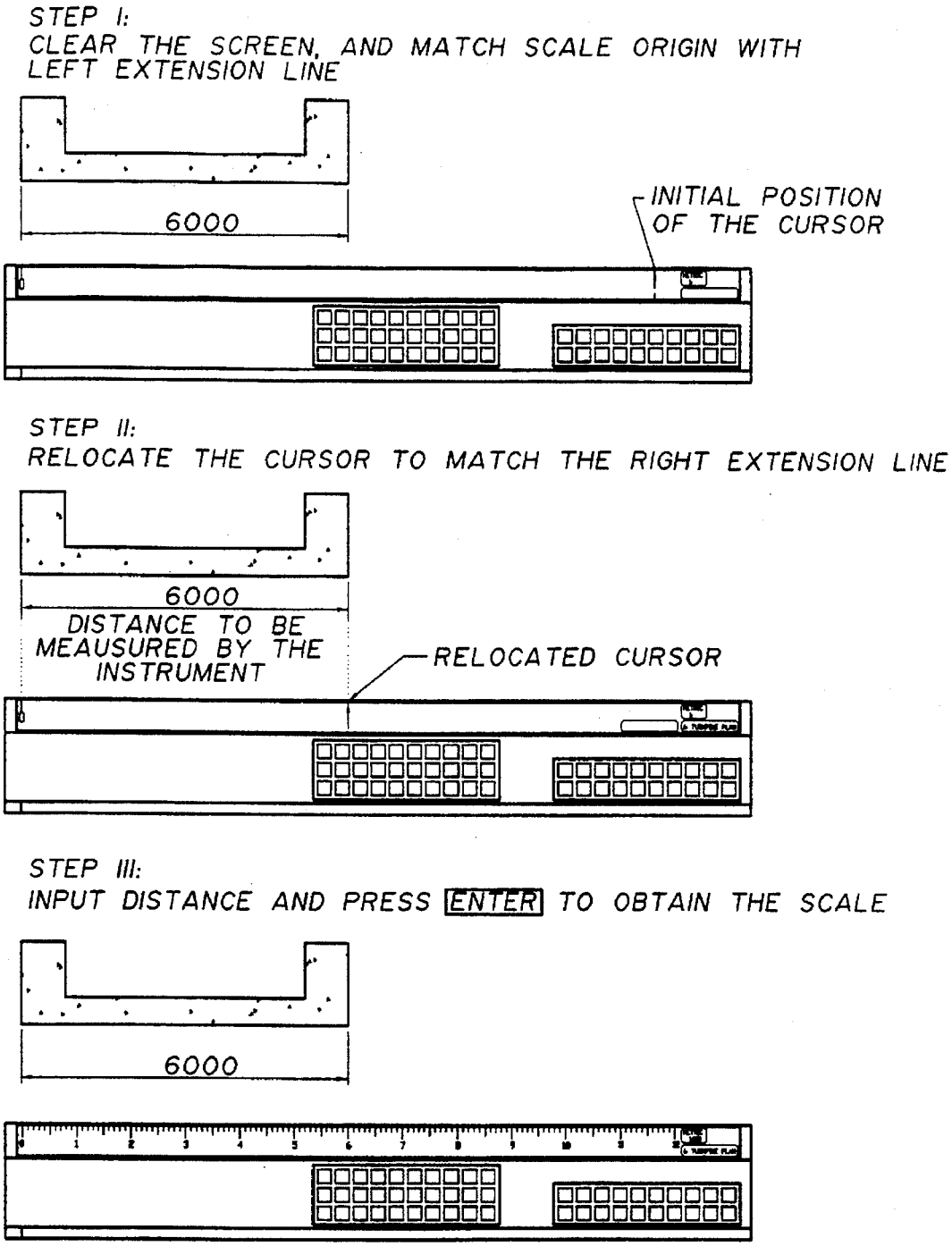
FIG. 26 is a top view of a ruler used to determine the scaling factor in a drawing sheet and show the graphically represented scale.

In certain applications, it may also be desirable to determine the scaling factor for a particular drafting sheet as shown in FIG. 26. Typical problems arise when sequential copying has altered the scaling factor of a drafting chart to an unrecognizable scaling factor, or the drawings are showing the wrong scaling factor, or the drawings show no scaling information at all. To determine a scaling factor for an existing plan, when the instrument prompts the user for the scaling factor, the user begins by relocating the origin to the left extension of a line on the drawing. A cursor is activated and located to the right extension of the line. When the cursor position is entered, the instrument prompts the user for the dimension indicated on the drafting chart. The units of this dimensions are selected using the scan keys and then entered with the numerical keys. The processing electronics compute the scaling factor for the drawing sheet and generate the appropriate scale represented in the scale and scale information box in the display screen. The scale may be further adjusted as necessary.

The present invention preferably can determine a scaling factor to fit a drawing in a sheet of given dimensions. In this operation, the user may quickly determine the appropriate scaling factor to fit a drawing in a sheet of paper. This is particularly important when the available space is limited or when no standard scale adequately maximizes usage of the available space. One proceeds in the same fashion as above to determine the appropriate scaling factor to fit onto a particular size drafting sheet.

The ability to store and recall previously stored scale information provides the advantage of easy access to the scaling factors for specific projects. To store a scale in memory, the store key initiates an information box to prompt the user to name the file using alphanumeric keys. The information box also shows a file number assigned to the file, the unit system of the scale, and the scaling factor. When the information is entered, the file is stored in chronological order and the scale is again graphically represented in the display screen. In addition, the current scale file box reflects the number and name of the file.

The stored files can be recalled at any time. To recall a stored file from memory, the recall key activates an information box to display stored files. Each file entry preferably displays the file number, name, unit system, and scaling factor. Using the scan keys, the user can highlight the desired file so that the file number blinks. When a file is selected, the display screen and the scale information box reflect the scale selected. The information box then returns to the main menu.

The invention may preferably include scaling factors preprogrammed into the processing electronics which may be recalled in the same manner.

For embodiments with more than one display screen, the display screens are preferably independent of each other. Consequently, the scales or scaling factors associated with these display screens may also be independent of each other.

Figure 22:
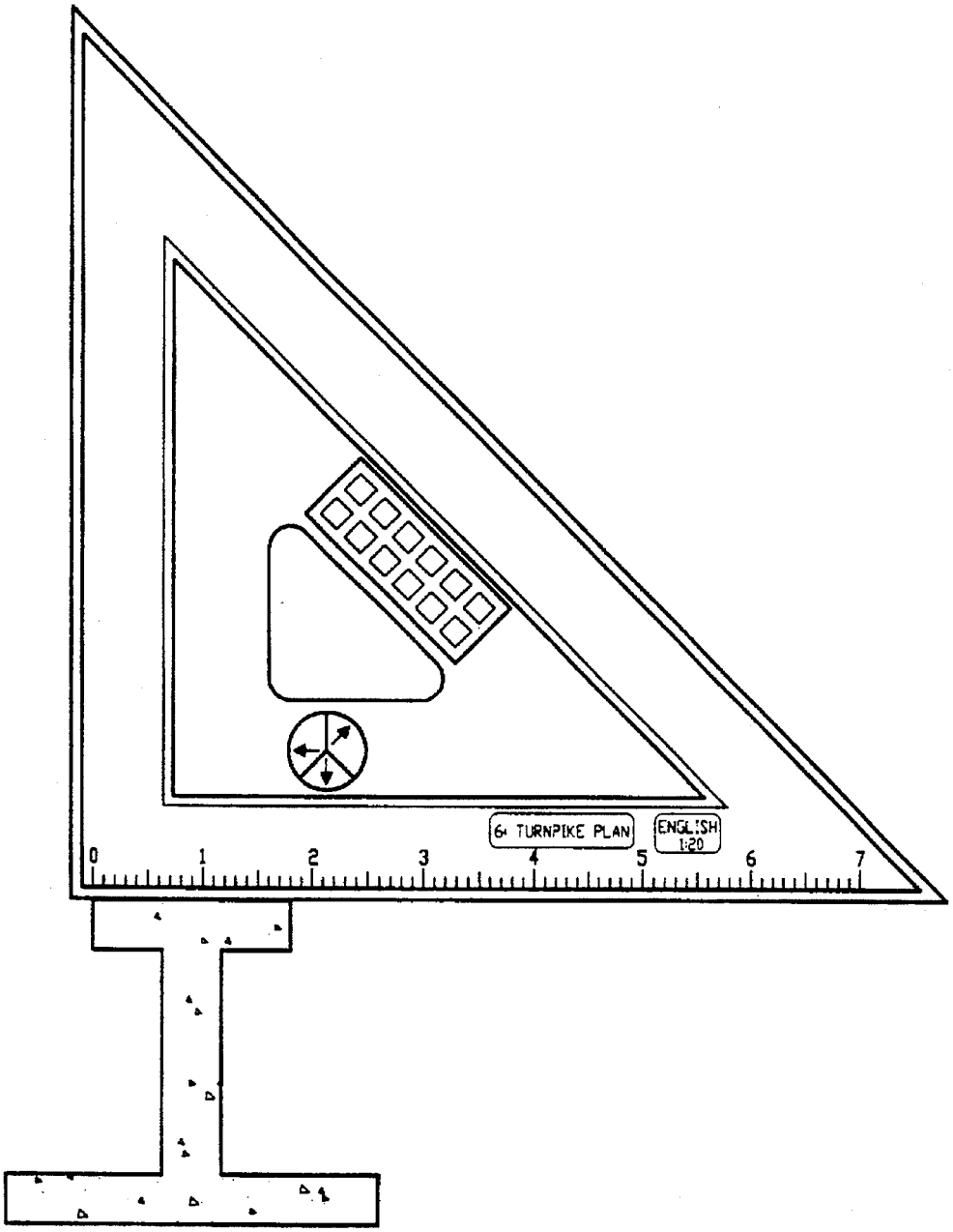
FIG. 22 is a top view of a drafting triangle used to measure the top side of an object.
Figure 23:
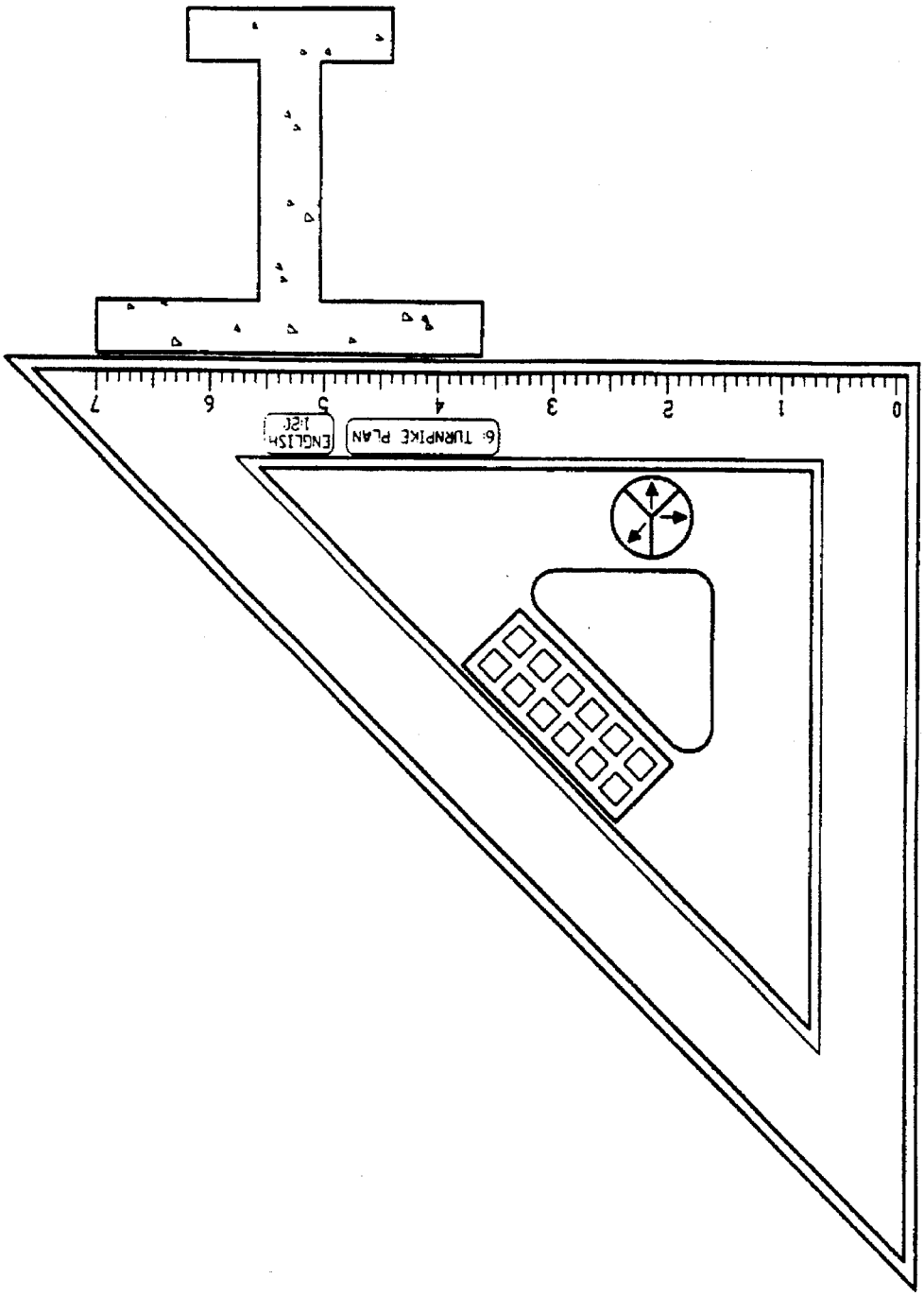
FIG. 23 is a top view of the drafting triangle showing an inverted scale used to measure the bottom side of an object.
Figure 24:
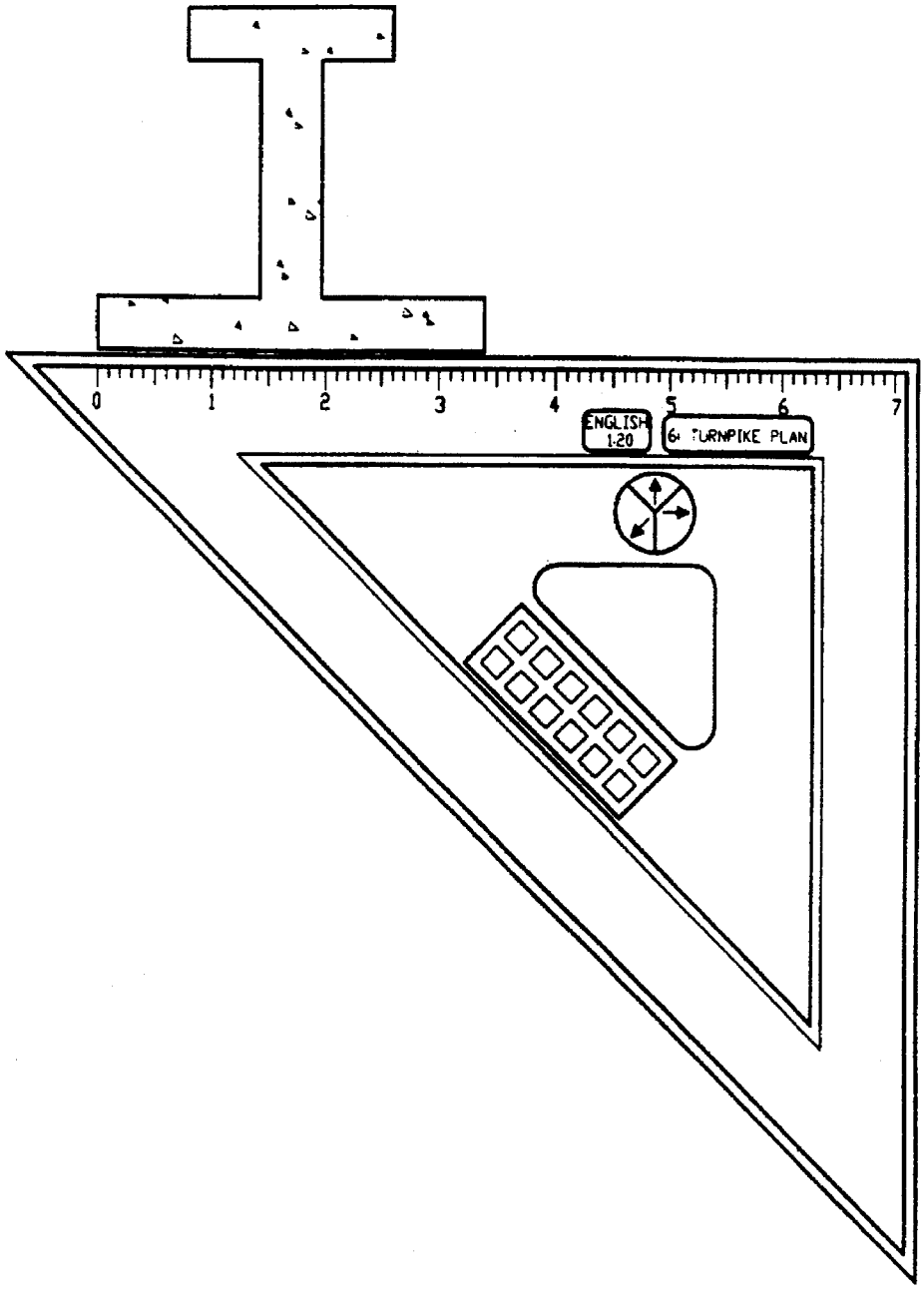
FIG. 24 is a top view of the drafting triangle with the scale transposed.

As another feature of the preferred embodiment, the display screen may be read in any orientation as shown in FIGS. 22 through 24. For example, if a scale is displayed upside down, the characters on the scale can be transposed by pressing a transpose button in the user keyboard to facilitate reading. As shown in FIG. 22, this might occur when a user measures an upper side of an object, and then wished to measure the lower side of that object. To measure the lower side, the user can bring the object down below the lower side. In the process of inverting the instrument, the scale also becomes inverted. The user then preferably transposes the scale by pressing the transpose key.

Each of the body shapes of the present invention can include advanced features. For example, a handheld computer widens the potential of the instrument by providing a powerful handheld computer which can receive external software, preferably stored on semiconductor chips, with engineering applications in addition to all of the functions described above and preferably provided as default.

The engineering application feature allows the user to select programs from a dialog box. For the simpler and most commonly used operations, the programs can be built-in to the present invention, the more complicated and/or unusual operations can be accessed from a large variety of data storage devices or chips.

A preferred built-in engineering application includes a unit conversion feature wherein the user has to define the unit group (length, mass, area, etc.). The unit system and unit of measurement to convert from and the unit system and unit of measurement to convert to must be input, of course.

The information box shows the original figure with its corresponding unit of measurement and unit system, the conversion coefficient, and the converted figure with its corresponding unit of measurement and unit system.

Another preferred built-in application includes a formulary menu offering a large variety of helpful formulas (cataloged by groups such as areas, volumes, inertia, etc.) and calculate them at the user's convenience. The general procedure for all groups is as follows: select the group, select the figure from the list, view the Display screen showing the figure and what dimensions to enter, and enter the required data (e.g., number of sides, radius of the inscribed circumference and the side dimension) to obtain the answer.

Preferably, the area and volume for the following geometric figures can be calculated: square, triangle, circle, circular segment, circular sector, ellipse, regular polygon, ring, cylinder development area, and trapezoid. The volumes of the following geometric figures can preferably be calculated: prism, sphere, sphere segment, pyramid, truncated pyramid, cone, truncated cone, and cylinder.

Another advanced feature, a curve design master, calculates and aides the user in plotting horizontal curves, vertical curves and straight grades. This function operates according to a program conventionally available or known to one of ordinary skill in the art. Depending on the capacity of the instrument, this program could be permanently installed or be inserted by the user when desired. This operation is greatly simplified by the menu system prompting instructions with a information box. Other advantages include the abilities to store different trials for later retrieval, to quickly check, and to draw and correct curves while in the field. In this manner, concentration may be focused on curve design itself thereby eliminating the distraction of note taking.

For vertical curves, the system requires the location and elevation of the beginning station (PC) or point of intersection station (PI), the beginning and ending grades, and the length of the curve. Alternatively, the elevation at the high or low point, or station and elevation of the curve can be input instead of the curve length. The system outputs stations and elevations for the beginning, intersection and ending stations.

Once a vertical curve has been calculated and stored, the instrument may be pinned at the point of beginning (PC). When the plot key is pressed, an information box shows the beginning grade and the instrument can be rotated to the indicated grade. A crest vertical curve corresponds to a clockwise rotation of the instrument and a sag vertical curve corresponds to a counterclockwise rotation. At this stage, the cursor on the screen appears at every station-interval showing the station, elevation and the location of the point to be plotted, including the high or low point. The user marks the point and connects them using a French curve.

Horizontal curves are substantially the same as vertical curves, and the procedure to plot points is similar. Differences include input angles being given as bearings, and the beginning, inflection and ending points being defined by stations and offsets. The instrument can be rotated clockwise for right turns and counterclockwise for left turns.

The output for horizontal curves provides the geometric layout of the road, which is the backbone of any road design. In countries where advanced technology is not available, this feature provides great assistance when using the traditional surveying tools.

This feature greatly simplifies the most time consuming portions of curve design by allowing the user to immediately have the station and elevation at the exact location to be plotted. By encouraging more attempts, the conceptual design becomes more accurate.

There may be some variations from the preceding concepts according to the application intended for each tool. For example, if the drafting triangle could be built with several feature combinations, its width may vary according to the total numbers of keys required. Moreover, the instruments could be produced with different combinations of operations. Economy models might only use standard scales, set new working scales, store scale files in memory, and recall previously stored scale files. In contrast, more expensive models might offer option for both standard and non-standard scales, for setting a new working scales, for finding an existing plan scales, for determining the appropriate scaling factors to fit a drawing in a sheet of given dimensions, for storing scale files in memory, for recalling previously stored scale files, and for converting scales from one unit system to another.

This new line of drafting instruments combines many existing drafting instruments with scales in different unit systems into a single tool, and renders several traditional drafting tools obsolete. The same instrument serves to determine angles, slopes, and elevations. In addition, the present invention significantly aides the user in roadway geometry design. Through its menu system and graphically represented display, the instrument follows the user's thinking process thereby making the design process more efficient. This invention provides a great advantage to a wide variety of persons including professionals, students, technicians, economists and physicists.

The foregoing description of preferred embodiments of the invention has been presented for purposes of illustration and description. It is not intended to be exhaustive or to limit the invention to the precise form disclosed, and modification and variations are possible in light of the above teachings or may be acquired from practice of the invention. The embodiments were chosen and described in order to explain the principle of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed:

1. A drafting instrument adapted for rapid measurement by a user of diagrams or drawings on a surface comprising:

a body having an edge and a cavity;

means for detecting movement of said body on the surface and for generating a signal representing detected movement, said detection means located adjacent to said body;

electronics processing means operatively connected to said detection means and located in said cavity for receiving and processing said signal from said detecting means to generate a display output signal;

display means operatively connected to said electronics processing means and located adjacent to said edge for displaying an image including a scale, said display means receiving said output signal from said processing means so that said scale electronically scrolls.

2. The drafting instrument of claim 1, wherein the display means is adapted to electronically scroll an appropriate amount as said body moves a corresponding distance detected by said detecting means.

3. The drafting instrument of claim 1, wherein the display means is adapted to electronically scroll when a key on a keyboard is pressed.

4. The drafting instrument of claim 1, wherein said body is configured as a ruler having a generally rectangular shape.

5. The drafting instrument of claim 4, wherein said body further includes a member slidably attached to said body, said member having a second edge oriented 90° with respect to said first edge.

6. The drafting instrument of claim 1, wherein said body is configured as a drafting triangle having a top surface triangular in shape.

7. The drafting instrument of claim 1, wherein said body comprises a protractor having a top surface semicircular in shape.

8. The drafting instrument of claim 1, wherein said body comprises a protractor having a top surface circular in shape.

9. The drafting instrument according to claim 1, wherein said detection means includes a bearing located at an end of said body.

10. The drafting instrument according to claim 1, wherein said detection means is adapted to use a digitizing band to register displacement.

11. The drafting instrument according to claim 1, wherein said display means comprises a liquid crystal display.

12. The drafting instrument according to claim 1, further comprising an input means operatively connected to the electronic processing means for receiving input from the user of the drafting instrument to control its operation.

13. The drafting instrument according to claim 12, wherein said input means is adapted to receive input from the user indicating a desired scale.

14. The drafting instrument according to claim 13, wherein said input means is adapted to receive input from the user to toggle between English and Metric system scales.

15. The drafting instrument according to claim 12, wherein the processing electronics means is adapted to perform calculations entered using said input means.

16. The drafting instrument according to claim 15, wherein said electronic processing means calculates an angular measurement utilizing displacement components measured by said drafting instrument and in response to input received by said input means.

17. A self-contained drafting instrument adapted for rapid measurement by a user of diagrams or drawings on a surface comprising:

a body having an edge and a cavity;

means for detecting two dimensional movement of said body on the surface and for generating a signal representing the horizontal and vertical displacement components of the two dimensional movement of said body on the surface, said detection means located adjacent to said body;

electronics processing means operatively connected to said detection means and located in said cavity for receiving and processing said signal from said detecting means to generate a display output signal;

display means operatively connected to said electronics processing means for displaying information corresponding to the vertical and horizontal displacement components, said display means receiving said output signal from said processing means to change said information as said body moves.

18. The drafting instrument of claim 17, wherein said information comprises a first numeric readout for said horizontal displacement component and a second numeric readout for said vertical displacement component.

19. The drafting instrument of claim 17, wherein said display means is located adjacent to said edge and is capable of graphical representation of a scale.

20. The drafting instrument of claim 19, wherein said graphical representation of said scale displayed by said display means can electronically scroll.

21. The drafting instrument of claim 17, wherein said body comprises a ruler having a generally rectangular shape.

22. The drafting instrument of claim 21, wherein said body further includes a member slidably attached to said body, said member having a second edge oriented 90° with respect to said first edge.

23. The drafting instrument of claim 17, wherein said body comprises a drafting triangle having a top surface triangular in shape.

24. The drafting instrument of claim 17, wherein said body comprises a protractor having a top surface semicircular in shape.

25. The drafting instrument of claim 17, wherein said body comprises a protractor having a top surface circular in shape.

26. The drafting instrument according to claim 17, wherein said detecting means includes a bearing located at an end of said body.

27. The drafting instrument according to claim 17, wherein said detection means is adapted to use a digitizing band to register displacement.

28. The drafting instrument according to claim 17, wherein said display means comprises a liquid crystal display.

29. The drafting instrument according to claim 17, further comprising an input means operatively connected to the electronic processing means for receiving input from the user of the drafting instrument to control its operation.

30. The drafting instrument according to claim 29, wherein the processing electronics means is adapted to perform calculations entered using said input means.

31. The drafting instrument according to claim 30, wherein said electronic processing means calculates an angular measurement utilizing displacement components measured by said drafting instrument and in response to input received by said input means.

32. A drafting instrument adapted for rapid measurement of angles or slopes on diagrams on a surface comprising:

a body having an edge and a cavity;

fixing means located proximate to said edge and adapted to allow said body to be rotated through an angular displacement on the surface about an axis passing through said fixing means and orthogonal to the surface;

means for detecting movement of said body on the surface and for generating a signal representing detected movement, said detecting means located adjacent to said body;

electronics processing means operatively connected to said detection means and located in said cavity for receiving and processing said signal from said detecting means to generate a display output signal;

display means operatively connected to said electronics processing means and located adjacent to said edge for displaying information corresponding to said angular displacement of said body, said display means receiving output signal from said processing means to change said information as said body is rotated.

33. The drafting instrument of claim 32, wherein said fixing means comprises a depressible pin capable of being fixed to the surface.

34. The drafting instrument of claim 32, wherein said display means includes a numeric readout for said angular displacement.

35. The drafting instrument according to claim 32, wherein said display means comprises a liquid crystal or any other display.

36. The drafting instrument of claim 32, wherein said body has a generally rectangular shape.

37. The drafting instrument according to claim 32, wherein said detection means includes bearings located at an end of said body.

38. The drafting instrument according to claim 32, further comprising an input means operatively connected to the electronic processing means for receiving input from the user of the drafting instrument to control its operation.

39. The drafting instrument according to claim 38, wherein the processing electronics means is adapted to perform calculations entered using said input means.

40. The drafting instrument according to claim 39, wherein said electronic processing means calculates an angular measurement utilizing displacement components measured by said drafting instrument and in response to input received by said input means.

* * * * *